US007945059B2

(12) United States Patent
Miyazaki

(10) Patent No.: US 7,945,059 B2
(45) Date of Patent: May 17, 2011

(54) SPEAKER DEVICE, SOUND REPRODUCING METHOD, AND SPEAKER CONTROL DEVICE

(75) Inventor: Shinichi Miyazaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1110 days.

(21) Appl. No.: 11/681,710

(22) Filed: Mar. 2, 2007

(65) Prior Publication Data

US 2007/0223724 A1 Sep. 27, 2007

(30) Foreign Application Priority Data

Mar. 3, 2006 (JP) ..... 2006-057324
Feb. 6, 2007 (JP) ..... 2007-026549

(51) Int. Cl.
*H04R 3/00* (2006.01)

(52) U.S. Cl. ..... 381/116; 381/77; 381/79; 381/82; 370/281; 370/295

(58) Field of Classification Search ..... 381/77–79, 381/116, 2, 82; 370/281, 295
See application file for complete search history.

(56) References Cited

U.S. PATENT DOCUMENTS 5,497,372 A * 3/1996 Nankoh et al. ..... 370/480
2003/0185405 A1* 10/2003 Spencer et al. ..... 381/77
2005/0220311 A1* 10/2005 Sun et al. ..... 381/77
2007/0154036 A1* 7/2007 Matsuzawa ..... 381/116

FOREIGN PATENT DOCUMENTS

JP 2003-047085 2/2003

* cited by examiner

*Primary Examiner* — Vivian Chin
*Assistant Examiner* — Friedrich Fahnert
(74) *Attorney, Agent, or Firm* — Workman Nydegger

(57) ABSTRACT

A speaker device mixes an audible frequency band signal wave with a modulated wave obtained by modulating an ultrasonic frequency band carrier wave with an audible frequency band signal so as to generate a synthesis wave, and drives an ultrasonic transducer with the synthesis wave so as to reproduce a signal sound.

4 Claims, 18 Drawing Sheets

SPEAKER DEVICE, SOUND REPRODUCING METHOD, AND SPEAKER CONTROL DEVICE

BACKGROUND

1. Technical Field

The present invention relates to a speaker device that is capable of outputting a modulated wave obtained by modulating a carrier wave in an ultrasonic wave band with a sound signal in an audible band to reproduce a sound having high directivity, while functioning as a common loudspeaker having low directivity, a sound reproducing method, and a speaker control device.

2. Related Art

As information apparatuses have been developed and spread, in a public space, various sounds have been discharged from various information apparatuses. However, an unnecessary sound or announce confuses an individual person or gives the individual person an unpleasant feeling, thereby making the individual person under stress. For this reason, it is required to improve a sound environment by reducing noises in the public space. For example, at the time of a public announcement, if sound information can be provided over a specific area (area on-demand), noises can be prevented from propagating into a peripheral area, and an announce effect can be improved.

Meanwhile, a super-directivity speaker, such as an ultrasonic speaker (for example, see JP-A-2003-47085), which can reproduce a sound having high directivity, has attracted attention.

The ultrasonic speaker outputs a modulated wave obtained by modulating a carrier wave in an ultrasonic wave band with a sound signal in an audible band so as to reproduce a sound having high directivity.

Meanwhile, if it is assumed that a super-directivity speaker, such as an ultrasonic speaker, is used as a loudspeaker, there are two cases, that is, a case where sound information is announced over a specific area and a case where sound information is announced over a relatively wide area. When using a super-directivity speaker according to the related art, a sound having extraordinarily high directivity can be only reproduced. For this reason, when sound information is announced over a relatively wide area, a loudspeaker needs to be separately provided.

Further, the super-directivity speaker (ultrasonic speaker) according to the related art has a characteristic of having extraordinarily high directivity, but since a reproducing space is extraordinarily narrow, a sound can be heard only in a pinpoint area. When a sound is provided to a specific individual person, a large problem does not occur. However, when a sound is provided over a range having a predetermined large area, since one super-directivity speaker cannot cover the range, a plurality of super-directivity speakers need to be disposed. As a result, a size of a system is increased, which becomes inconvenient for use.

Further, in the ultrasonic speaker, when a carrier frequency is changed, a directivity angle of a demodulated sound can be changed. However, it is not possible to much change the directivity angle of the reproduced sound (self-demodulated sound) due to restrictions in a sound wave radiating area of a speaker (diameter of the speaker) and a variable range of a carrier (ultrasonic) frequency.

As such, it is difficult to much change a directivity angle (reproduction area) of a reproduced sound in the super-directivity speaker according to the related art.

Furthermore, as a type of the super-directivity speaker, in an ultrasonic speaker that uses an electrostatic ultrasonic transducer, shapes or sizes of units of the electrostatic ultrasonic transducer are optimized such that a sound signal having a maximum sound pressure is output in an ultrasonic frequency band, in a frequency characteristic of the electrostatic ultrasonic transducer. For this reason, a frequency characteristic is obtained in which an output sound pressure is gradually lowered from an ultrasonic frequency band to an audible frequency band. As such, since the electrostatic ultrasonic transducer does not have a uniform output sound pressure frequency characteristic in the audible frequency band, if an input audible sound signal is output from the electrostatic ultrasonic transducer without a frequency characteristic of the audible sound signal being corrected and is reproduced as a direct sound, the audible sound may be reproduced as a sound in which a high pass (ultrasonic frequency band) is emphasized and a balance is collapsed, and thus a sound quality may be deteriorated.

SUMMARY

An advantage of some aspects of the invention is that it provides a speaker device that is capable of functioning as a super-directivity speaker and a loudspeaker and improving a sound quality, a sound reproducing method, and a speaker control device.

Another advantage of some aspects of the invention is that it provides a speaker device that is capable of changing a directivity angle (reproduction area) of a reproduced sound on a large scale as compared with a super-directivity speaker according to the related art, a sound reproducing method, and a speaker control device.

According to a first aspect of the invention, there is provided . . . speaker device that mixes an audible frequency band signal wave with a modulated wave obtained by modulating an ultrasonic frequency band carrier wave with an audible frequency band signal so as to generate a synthesis wave, and drives an ultrasonic transducer with the synthesis wave so as to reproduces a signal sound.

According to this structure, the audible frequency band signal wave, and the modulated wave obtained by modulating the ultrasonic frequency band carrier wave with the audible frequency band signal are mixed so as to generate a synthesis wave, and the ultrasonic transducer is driven with the synthesis wave so as to reproduce the signal sound.

Accordingly, the modulated wave in the ultrasonic frequency band and the audible frequency band signal are simultaneously generated by one ultrasonic transducer, which obtains a hybrid speaker device that is capable of achieving a super-directivity speaker (ultrasonic speaker) and a loudspeaker by one ultrasonic transducer.

According to a second aspect of the invention, a speaker device includes a carrier wave generating unit that generates an ultrasonic frequency band carrier wave, a modulating unit that modulates the ultrasonic frequency band carrier wave output by the carrier wave generating unit with an audible frequency band input signal, a level controller that controls a level ratio between a modulated wave output by the modulating unit and the audible frequency band input signal, a mixer that mixes the modulated wave and the audible frequency band input signal whose levels are controlled by the level controller so as to generate a synthesis wave, and an ultrasonic transducer that is driven with the synthesis wave and reproduces a signal sound.

According to this structure, the carrier wave generating unit generates the ultrasonic frequency band carrier wave, and the modulating unit modulates the ultrasonic frequency band carrier wave output from the carrier wave generating unit with the audible frequency band input signal.

Further, the level controller controls the level ratio between the modulated wave output by the modulating unit and the audible frequency band input signal to the predetermined ratio, and the mixer mixes the modulated wave and the audible frequency band signal whose levels are controlled by the level controller so as to generate the synthesis wave. The ultrasonic transducer is driven with the synthesis wave so as to reproduce the signal sound.

Accordingly, since the level controller controls the level ratio between the modulated wave and the audible frequency band input signal to the predetermined ratio, it is possible to change a directivity angle of the sound output from the ultrasonic transducer. That is, if the ratio of the modulated signal is increased, directivity becomes higher, and when the ratio of the audible frequency band input signal is increased, the directivity becomes lower. For this reason, the level ratio between the modulated wave and the audible frequency band input signal is controlled such that the speaker device functions as a pure super-directivity speaker or a pure loudspeaker, thereby simultaneously realizing functions of the super-directivity speaker and the loudspeaker.

According to a third aspect of the invention, a speaker device includes a carrier wave generating unit that generates an ultrasonic frequency band carrier wave, a modulating unit that modulates the ultrasonic frequency band carrier wave output by the carrier wave generating unit with an audible frequency band input signal, a phase shifter that shifts a phase of the audible frequency band input signal, a level controller that controls a level ratio between a modulated wave output by the modulating unit and the audible frequency band input signal whose phase is shifted by the phase shifter, a mixer that mixes the modulated wave and the audible frequency band input signal whose levels are controlled by the level controller so as to generate a synthesis wave, and an ultrasonic transducer that is driven with the synthesis wave and reproduces a signal sound.

According to this structure, the carrier wave generating unit generates the ultrasonic frequency band carrier wave, and the modulating unit modulates the ultrasonic frequency band carrier wave output from the carrier wave generating unit with the audible frequency band input signal.

Further, the phase shifter shifts the phase of the audible frequency band input signal, and the level controller changes the level ratio between the modulated wave output by the modulating unit and the audible frequency band input signal whose phase is shifted by the phase shifter. The mixer mixes the modulated wave and the audible frequency band input signal whose levels are controlled by the level controller so as to generate the synthesis wave. The ultrasonic transducer is driven with the synthesis wave so as to reproduce a signal sound.

Accordingly, according to this structure, since the level controller controls the level ratio between the modulated wave and the audible frequency band input signal to the predetermined ratio, it is possible to change a directivity angle of the sound output from the ultrasonic transducer. In addition, after shifting the phase of the audible frequency band input signal mixed with the modulated wave, the modulated wave and the audible frequency band signal are mixed with each other, and thus positive and negative asymmetry in amplitude of the synthesis waveform is suppressed. For this reason, the load is reduced which is applied to the vibrating membrane or the driving circuit of the ultrasonic transducer, which lengthens a life span of a system.

According to a fourth aspect of the invention, a speaker device includes a carrier wave generating unit that generates an ultrasonic frequency band carrier wave, a modulating unit that modulates the ultrasonic frequency band carrier wave output by the carrier wave generating unit with an audible frequency band input signal, a phase shifter that shifts a phase of the audible frequency band input signal by 90 degrees or approximately 90 degrees, a level controller that controls a level ratio between a modulated wave output by the modulating unit and the audible frequency band input signal whose phase is shifted by 90 degrees or approximately 90 degrees by the phase shifter, a mixer that mixes the modulated wave and the audible frequency band input signal whose levels are controlled by the level controller so as to generate a synthesis wave, and an ultrasonic transducer that is driven with the synthesis wave and reproduces a signal sound.

According to this structure, the carrier wave generating unit generates the ultrasonic frequency band carrier wave, and the modulating unit modulates the ultrasonic frequency band carrier wave output from the carrier wave generating unit with the audible frequency band input signal.

Further, the phase shifter shifts the phase of the audible frequency band input signal by 90 degrees (or approximately 90 degrees), the level controller controls a level ratio between the modulated wave output by the modulating unit and the audible frequency band input signal whose phase is shifted by 90 degrees by the phase shifter. The mixer mixes the modulated wave and the audible frequency band input signal whose levels are controlled by the level controller so as to generate a synthesis wave, and the ultrasonic transducer is driven with the synthesis wave so as to reproduce a signal sound.

Accordingly, according to this structure, since the level controller controls the level ratio between the modulated wave and the audible frequency band input signal to the predetermined ratio, it is possible to change a directivity angle of the sound output from the ultrasonic transducer. In addition, after shifting the phase of the audible frequency band input signal mixed with the modulated wave by 90 degrees (or approximately 90 degrees), the modulated wave and the audible frequency band signal are mixed with each other, and thus positive and negative asymmetry in amplitude of the synthesis waveform is suppressed. For this reason, the load is reduced which is applied to the vibrating membrane or the driving circuit of the ultrasonic transducer, which lengthens a life span of a system.

According to a fifth aspect of the invention, a speaker device includes a carrier wave generating unit that generates an ultrasonic frequency band carrier wave, a first filter that receives an audible frequency band input signal and has a predetermined pass band characteristic, a phase shifter that shifts a phase of the audible frequency band input signal by 90 degrees or approximately 90 degrees, a modulating unit that modulates the ultrasonic frequency band carrier wave output by the carrier wave generating unit with the audible frequency band input signal that is an output signal of the first filter, a second filter that receives the audible frequency band input signal being an output signal of the phase shifter and has a different pass band characteristic from the first filter, a level controller that controls a level ratio between a modulated wave output by the modulating unit and the audible frequency band input signal that is an output signal of the second filter, a mixer that mixes the modulated wave and the audible frequency band input signal whose levels are controlled by the level controller so as to generate a synthesis wave, and an ultrasonic transducer that is driven with the synthesis wave and reproduces a signal sound.

According to this structure, the carrier wave generating unit generates the ultrasonic frequency band carrier wave, the audible frequency band input signal is input to the first filter having the predetermined pass band characteristic, and the signal having the predetermined pass band is output.

Further, the modulating unit modulates the ultrasonic frequency band carrier wave output by the carrier wave generating unit with the audible frequency band input signal that is the output signal of the first filter.

Meanwhile, the audible frequency band input signal is input to the second filter having the different audible frequency band signal from the first filter, and the signal having the predetermined pass band is output.

The level controller controls the level ratio between the modulated wave output by the modulating unit and the audible frequency band input signal being the output signal of the second filter to the predetermined ratio, and the mixer mixes the modulated wave and the audible frequency band signal whose levels are controlled by the level controller so as to generate a synthesis wave. The ultrasonic transducer is driven with the synthesis wave so as to reproduce the signal sound.

Accordingly, since the level controller controls the level ratio between the modulated wave and the audible frequency band input signal to the predetermined ratio, it is possible to change a directivity angle of the sound output from the ultrasonic transducer.

The second filter is composed of a high pass filter (HPF), and the cutoff frequency of the high pass filter in the frequency characteristic is changed, which changes directivity of the reproduced sound.

Further, the first filter is composed of an equalization filter that equalizes a frequency characteristic of a demodulated sound or an inverse filter that suppresses unnecessary intermodulation distortion at the time of self-demodulation, so as to form a filter having a frequency characteristic of improving a sound quality of a beam sound, or making up for or emphasizing the audible band signal having passed through the second filter, such that the sound effect can be further improved.

According to a sixth aspect of the invention, a speaker device includes a carrier wave generating unit that generates an ultrasonic frequency band carrier wave, a first filter that receives an audible frequency band input signal and has a predetermined pass band characteristic, a phase shifter that shifts a phase of the audible frequency band input signal by 90 degrees or approximately 90 degrees, a modulating unit that modulates the ultrasonic frequency band carrier wave output by the carrier wave generating unit with the audible frequency band input signal that is an output signal of the first filter, a second filter that receives the audible frequency band input signal being an output signal of the phase shifter and has a different pass band characteristic from the first filter, a level controller that controls a level ratio between a modulated wave output by the modulating unit and the audible frequency band input signal that is an output signal of the second filter, a mixer that mixes the modulated wave and the audible frequency band input signal whose levels are controlled by the level controller so as to generate a synthesis wave, and an ultrasonic transducer that is driven with the synthesis wave and reproduces a signal sound.

According to this structure, the carrier wave generating unit generates the ultrasonic frequency band carrier wave, the audible frequency band input signal is input to the first filter having the predetermined pass band characteristic, and the signal having the predetermined pass band is output.

Further, the audible frequency band input signal is shifted by 90 degrees (or approximately 90 degrees) by the phase shifter and is then input to the second filter having the different pass band characteristic from the first filter, and the signal having the predetermined pass band is output from the second filter.

Further, the modulating unit modulates the ultrasonic frequency band carrier wave output by the carrier wave generating unit with the audible frequency band input signal that is the output signal of the first filter. The level controller controls the level ratio between the modulated wave output by the modulating unit and the audible frequency band input signal being the output signal of the second filter to the predetermined ratio, and the mixer mixes the modulated wave and the audible frequency band signal whose levels are controlled by the level controller so as to generate a synthesis wave. The ultrasonic transducer is driven with the synthesis wave so as to reproduce the signal sound.

Accordingly, according to this structure, since the level controller controls the level ratio between the modulated wave and the audible frequency band input signal to the predetermined ratio, it is possible to change a directivity angle of the sound output from the ultrasonic transducer. In addition, after shifting the phase of the audible frequency band input signal mixed with the modulated wave by 90 degrees (or approximately 90 degrees), the modulated wave and the audible frequency band signal are mixed with each other, and thus positive and negative asymmetry in amplitude of the synthesis waveform is suppressed. For this reason, the load is reduced which is applied to the vibrating membrane or the driving circuit of the ultrasonic transducer, which lengthens a life span of a system.

The second filter is composed of a high pass filter (HPF), and the cutoff frequency of the high pass filter in the frequency characteristic is changed, which changes directivity of the reproduced sound. As a result, it is possible to minutely control the directivity.

Further, the first filter is composed of an equalization filter that equalizes a frequency characteristic of a demodulated sound or an inverse filter that suppresses unnecessary intermodulation distortion at the time of self-demodulation, so as to form a filter having a frequency characteristic of improving a sound quality of a beam sound, or making up for or emphasizing the audible band signal having passed through the second filter, such that the sound effect can be further improved.

Preferably, the second filter has a pass band characteristic of a high pass filter, and a cutoff frequency of the high pass filter in the pass band characteristic is controlled.

According to this structure, the second filter is composed of a high pass filter (HPF), and a cutoff frequency of the high pass filter in the frequency characteristic is changed, which changes the directivity of the reproduced sound. As a result, it is possible to minute control the directivity.

Preferably, the first filter is composed of an equalization filter that has a frequency characteristic of equalizing a frequency characteristic of a demodulated sound.

According to this structure, it is possible to equalize the frequency characteristic of the demodulated sound, and to improve the sound quality of the beam sound being the sound output.

Preferably, the speaker device according to the sixth aspect of the invention further includes a third filter that is inserted between the second filter and the level controller and has a different pass band characteristic from the second filter.

According to this structure, the third filter is inserted between the second filter and the level controller. For example, the third filter has a pass characteristic that becomes a characteristic opposite to an output characteristic (attenuation characteristic) of the transducer in the audible frequency band.

Accordingly, the frequency characteristic of the direct sound finally output from the transducer (signal component of an audible frequency band reproduced through the second filter and the third filter) can be equalized. For this reason, the reproducing balance of the direct sound (sound having low directivity) that is output from the transducer is kept, and the sound quality can be prevented from being deteriorated.

Preferably, the third filter has a frequency characteristic of equalizing an overall output characteristic or a partial output characteristic of the ultrasonic transducer in the audible frequency band.

According to this structure, the third filter is inserted between the second filter and the level controller. The third filter has a frequency characteristic of equalizing an overall output characteristic or a partial output characteristic of the ultrasonic transducer in the audible frequency band.

Accordingly, the frequency characteristic of the direct sound finally output from the transducer (signal component of an audible frequency band reproduced through the second filter and the third filter) can be equalized. For this reason, the reproducing balance of the direct sound (sound having low directivity) that is output from the transducer is kept, and the sound quality can be prevented from being deteriorated.

Preferably, the speaker device according to the sixth aspect of the invention further includes a first signal input terminal that receives a first audible frequency band signal output as a sound having high directivity and a second signal input terminal that receives a second audible frequency band signal output as a sound having low directivity. The first audible frequency band signal is supplied to the modulating unit from the first signal input terminal, and the second audible frequency band signal is supplied to the level controller from the second signal input terminal.

According to this structure, the first audible frequency band signal output as a sound having high directivity is input through the first signal input terminal, and the second audible frequency band signal output as a sound having low directivity is input to the second signal input terminal. The first audible frequency band signal is supplied to the modulating unit, and the modulating unit modulates the ultrasonic frequency band carrier wave with the first audible frequency band signal.

Further, the level controller controls the level ratio between the modulated wave being the output of the modulating unit and the second audible frequency band signal, and the mixer mixes the modulated wave and the second audible frequency band signal. The ultrasonic transducer is driven with the synthesis wave so as to reproduce the signal sound.

As such, the channel CH1 outputting the signal as the sound having high directivity is separated from the channel CH2 outputting the signal as the sound having low directivity, and the synthesis wave obtained by mixing the signals is reproduced. By using this structure, a main voice (main vocal or sound announce) is assigned to the channel CH1 and a sub-voice (BGM, effect sound, or the like) is assigned to the channel CH2. As a result, it is possible to perform effective voice area guidance through one speaker device.

Preferably, the ultrasonic transducer is an electrostatic ultrasonic transducer.

According to this structure, the ultrasonic transducer is composed of an electrostatic ultrasonic transducer.

Since the electrostatic ultrasonic transducer can generate a high sound pressure over a wide frequency band ranging from the ultrasonic frequency band to the audible frequency band, it is possible to reproduce both the sound having high directivity (super-directivity speaker) and the sound having low directivity (loudspeaker) with a high sound pressure. Accordingly, it is possible to realize the functions of the super-directivity speaker and the loudspeaker by using one electrostatic ultrasonic transducer.

According to a seventh aspect of the invention, there is provided a sound reproducing method that reproduces a sound signal by a speaker device. The method includes generating an ultrasonic frequency band carrier wave, modulating the ultrasonic frequency band carrier wave output by the generating of the ultrasonic frequency band carrier wave with an audible frequency band input signal, controlling a level ratio between a modulated wave output by the modulating and the audible frequency band input signal, mixing the modulated wave and the audible frequency band input signal whose levels are controlled by the level controlling so as to generate a synthesis wave, and driving an ultrasonic transducer with the synthesis wave so as to reproduce a signal sound.

According to this structure, the ultrasonic frequency band carrier wave is generated, and is modulated with the audible frequency band input signal. The level ratio between the modulated wave and the audible frequency band input signal is controlled to the predetermined ratio, and the modulated wave and the audible frequency band input signal whose levels are controlled are mixed with each other so as to generate the synthesis wave. The ultrasonic transducer is driven with the synthesis wave.

Accordingly, since the level ratio between the modulated wave and the audible frequency band input signal is controlled to the predetermined ratio, it is possible to change a directivity angle of the sound output of the ultrasonic transducer. That is, if the ratio of the modulated signal is increased, the directivity becomes higher, and when the ratio of the audible frequency band signal is increased, the directivity becomes lower. For this reason, the level ratio between the modulated wave and the audible frequency band input signal is controlled such that the speaker device functions as a pure super-directivity speaker or a pure loudspeaker, thereby simultaneously realizing functions of the super-directivity speaker and the loudspeaker.

According to an eighth aspect of the invention, there is provided a sound reproducing method that reproduces a sound signal by a speaker device. The method includes generating an ultrasonic frequency band carrier wave, modulating the ultrasonic frequency band carrier wave output by the generating of the carrier wave with an audible frequency band input signal, shifting a phase of the audible frequency band input signal, controlling a level ratio between a modulated wave output by the modulating and the audible frequency band input signal whose phase is shifted by the phase shifting, mixing the modulated wave and the audible frequency band input signal whose levels are controlled by the level controlling so as to generate a synthesis wave, and driving an ultrasonic transducer with the synthesis wave so as to reproduce a signal sound.

According to this structure, the ultrasonic frequency band carrier wave is modulated with the audible frequency band input signal. Further, the phase of the audible frequency band input signal is shifted, the level ratio between the modulated wave and the audible frequency band signal whose phase is shifted is controlled, the modulated wave and the audible frequency band signal whose levels are controlled are mixed with each other to generate the synthesis wave, and the ultrasonic transducer is driven with the synthesis wave.

Accordingly, since the level ratio between the modulated wave and the audible frequency band input signal is controlled to the predetermined ratio, it is possible to change a directivity angle of the sound output of the ultrasonic transducer. After shifting the phase of the audible frequency band signal mixed with the modulated wave, the modulated wave and the audible frequency band signal are mixed with each other, and thus positive and negative asymmetry in amplitude of the synthesis wave is suppressed. For this reason, the load is reduced which is applied to the vibrating membrane or the driving circuit of the ultrasonic transducer, which lengthens a life span of a system.

According to a ninth aspect of the invention, there is provided a sound reproducing method that reproduces a sound signal by a speaker device. The method includes generating an ultrasonic frequency band carrier wave, modulating the ultrasonic frequency band carrier wave output by the carrier wave generating with an audible frequency band input signal, shifting a phase of the audible frequency band input signal by 90 degrees or approximately 90 degrees, controlling a level ratio between a modulated wave output by the modulating and the audible frequency band input signal whose phase is shifted by 90 degrees or approximately 90 degrees by the phase shifting, mixing the modulated wave and the audible frequency band input signal whose levels are controlled by the level controlling so as to generate a synthesis wave, and driving an ultrasonic transducer with the synthesis wave so as to reproduce a signal sound.

According to this structure, the ultrasonic frequency band carrier wave is modulated with the audible frequency band input signal. Further, the phase of the audible frequency band input signal is shifted by 90 degrees (or approximately 90 degrees), the level ratio between the modulated wave and the audible frequency band signal whose phase is shifted by 90 degrees is controlled, the modulated wave and the audible frequency band signal whose levels are controlled are mixed with each other to generate the synthesis wave, and the ultrasonic transducer is driven with the synthesis wave.

Accordingly, since the level ratio between the modulated wave and the audible frequency band input signal is controlled to the predetermined ratio, it is possible to change a directivity angle of the sound output of the ultrasonic transducer. After shifting the phase of the audible frequency band signal mixed with the modulated wave by 90 degrees (or approximately 90 degrees), the modulated wave and the audible frequency band signal are mixed with each other, and thus positive and negative asymmetry in amplitude of the synthesis wave is suppressed. For this reason, the load is reduced which is applied to the vibrating membrane or the driving circuit of the ultrasonic transducer, which lengthens a life span of a system.

According to a tenth aspect of the invention, there is provided a sound reproducing method that reproduces a sound signal by a speaker device. The method includes generating an ultrasonic frequency band carrier wave, causing an audible frequency band input signal to pass through a first filter having a predetermined pass band characteristic, modulating the ultrasonic frequency band carrier wave output by the carrier wave generating with an audible frequency band input signal that is an output signal of the first filter, causing the audible frequency band input signal to pass through a second filter having a different pass band characteristic from the first filter, controlling a level ratio between a modulated wave output by the modulating and the audible frequency band input signal that is an output signal of the second filter, mixing the modulated wave and the audible frequency band input signal whose levels are controlled by the level controlling so as to generate a synthesis wave, and driving an ultrasonic transducer with the synthesis wave so as to reproduce a signal sound.

According to this structure, the audible frequency band input signal is input to the first filter having the predetermined pass band characteristic, and the signal having the predetermined pass band is output. Further, the ultrasonic frequency band carrier wave is modulated with the audible frequency band signal that is the output signal of the first filter. Meanwhile, the audible frequency band input signal is input to the second filter having the different pass band characteristic from the first filter, and the signal having the predetermined pass band is output. The level ratio between the modulated wave and the audible frequency band signal being the output signal of the second filter is controlled to the predetermined ratio, and the modulated wave and the audible frequency band signal whose levels are controlled are mixed with each other so as to generate the synthesis wave. The ultrasonic transducer is driven with the synthesis wave, and reproduces the signal sound.

Accordingly, since the level ratio between the modulated wave and the audible frequency band input signal is controlled to the predetermined ratio, it is possible to change a directivity angle of the sound output from the ultrasonic transducer. Further, the second filter is composed of a high pass filter (HPF), and the cutoff frequency of the high pass filter in the frequency characteristic is changed, which changes directivity of the reproduced sound. Furthermore, the first filter is composed of an equalization filter that equalizes a frequency characteristic of a demodulated sound or an inverse filter that suppresses unnecessary intermodulation distortion at the time of self-demodulation, so as to form a filter having a frequency characteristic of improving a sound quality of a beam sound, or making up for or emphasizing the audible band signal having passed through the second filter, such that the sound effect can be further improved.

According to an eleventh aspect of the invention, there is provided a sound reproducing method that reproduces a sound signal by a speaker device. The method includes generating an ultrasonic frequency band carrier wave, causing an audible frequency band input signal to pass through a first filter having a predetermined pass band characteristic, shifting a phase of the audible frequency band input signal by 90 degrees or approximately 90 degrees, modulating the ultrasonic frequency band carrier wave output by the carrier wave generating with the audible frequency band input signal that is an output signal of the first filter, causing the audible frequency band input signal being an output signal by the phase shifting to pass through a second filter having a different pass band characteristic from the first filter, controlling a level ratio between a modulated wave output by the modulating unit and the audible frequency band input signal that is an output signal of the second filter, mixing the modulated wave and the audible frequency band input signal whose levels are controlled by the level controlling so as to generate a synthesis wave, and driving an ultrasonic transducer with the synthesis wave so as to reproduce a signal sound.

According to this structure, the audible frequency band input signal is input to the first filter having the predetermined pass band characteristic, and the signal having the predetermined pass band is output. Meanwhile, the phase of the audible frequency band input signal is shifted by 90 degrees (or approximately 90 degrees) and is then input to the second filter having the different pass band characteristic from the first filter, and the signal having the predetermined pass band is output from the second filter. Further, the ultrasonic frequency band carrier wave is modulated with the audible frequency band signal that is the output signal of the first filter.

The level ratio between the modulated wave and the audible frequency band signal being the output signal of the second filter is controlled to the predetermined ratio, and the modulated wave and the audible frequency band signal whose levels are controlled are mixed with each other so as to generate the synthesis wave. The ultrasonic transducer is driven with the synthesis wave, and reproduces the signal sound.

Accordingly, since the level ratio between the modulated wave and the audible frequency band input signal is controlled to the predetermined ratio, it is possible to change a directivity angle of the sound output from the ultrasonic transducer. In addition, after shifting the phase of the audible frequency band input signal mixed with the modulated wave by 90 degrees (or approximately 90 degrees), the modulated wave and the audible frequency band input signal are mixed with each other, and thus positive and negative asymmetry in amplitude of the synthesis waveform is suppressed. For this reason, the load is reduced which is applied to the vibrating membrane or the driving circuit of the ultrasonic transducer, which lengthens a life span of a system.

Further, the second filter is composed of a high pass filter (HPF), and the cutoff frequency of the high pass filter in the frequency characteristic is changed, which changes directivity of the reproduced sound. As a result, it is possible to minutely control the directivity.

Furthermore, the first filter is composed of an equalization filter that equalizes a frequency characteristic of a demodulated sound or an inverse filter that suppresses unnecessary intermodulation distortion at the time of self-demodulation, so as to form a filter having a frequency characteristic of improving a sound quality of a beam sound, or making up for or emphasizing the audible band signal having passed through the second filter, such that the sound effect can be further improved.

Preferably, the second filter has a pass band characteristic of a high pass filter, and a cutoff frequency of the high pass filter in the pass band characteristic is controlled.

According to this structure, the second filter is composed of a high pass filter (HPF), and the cutoff frequency of the high pass filter in the frequency characteristic is changed, which changes directivity of the reproduced sound. As a result, it is possible to minutely control the directivity.

Preferably, the first filter is composed of an equalization filter that has a frequency characteristic of equalizing a frequency characteristic of a demodulated sound.

According to this structure, it is possible to equalize the frequency characteristic of the demodulated sound, and to improve the sound quality of the beam sound being the sound output.

Preferably, sound reproducing method according to the eleventh aspect of the invention further includes causing an output of the second filter to pass through a third filter having a different pass band characteristic from the second filter, and controlling a level ratio between an output signal of the third filter and a modulated wave output by the modulating.

According to this structure, the output signal of the second filter is caused to pass through the third filter, and the level ratio between the output signal of the third filter and the modulated wave is controlled. For example, the third filter has a pass characteristic that becomes a characteristic opposite to an output characteristic (attenuation characteristic) of the transducer in the audible frequency band.

Accordingly, the frequency characteristic of the direct sound finally output from the transducer (signal component of an audible frequency band reproduced through the second filter and the third filter) can be equalized. For this reason, the reproducing balance of the direct sound (sound having low directivity) that is output from the transducer is kept, and the sound quality can be prevented from being deteriorated.

Preferably, the third filter has a frequency characteristic of equalizing an overall output characteristic or a partial output characteristic of the ultrasonic transducer in the audible frequency band.

According to this structure, the output signal of the second filter is caused to pass through the third filter, and the level ratio between the output signal of the third filter and the modulated wave is controlled. The third filter has a frequency characteristic of equalizing an overall output characteristic or a partial output characteristic of the ultrasonic transducer in the audible frequency band.

Accordingly, the frequency characteristic of the direct sound finally output from the transducer (signal component of an audible frequency band reproduced through the second filter and the third filter) can be equalized. For this reason, the reproducing balance of the direct sound (sound having low directivity) that is output from the transducer is kept, and the sound quality can be prevented from being deteriorated.

Preferably, the sound reproducing method according to the eleventh aspect of the invention further includes causing a first audible frequency band signal output as a sound having high directivity to be input to a first signal input terminal, and causing a second audible frequency band signal output as a sound having low directivity to be input to a second signal input terminal, modulating the ultrasonic frequency band carrier wave with the audible frequency band input signal modulating unit supplied from the first signal input terminal, and controlling a level ratio between the audible frequency band input signal supplied from the second signal input terminal and the modulated wave output by the modulating.

According to this structure, the first audible frequency band signal output as a sound having high directivity is input through the first signal input terminal, and the second audible frequency band signal output as a sound having low directivity is input to the second signal input terminal. The ultrasonic frequency band carrier wave is modulated with the first audible frequency band signal. After the level ratio between the modulated wave and the second audible frequency band signal is controlled, the modulated wave and the second audible frequency band signal are mixed with each other. The ultrasonic transducer is driven with the synthesis wave so as to reproduce the signal sound.

As such, the channel CH1 outputting the signal as the sound having high directivity is separated from the channel CH2 outputting the signal as the sound having low directivity, and the synthesis wave obtained by mixing the signals is reproduced. By using this structure, a main voice (main vocal or sound announce) is assigned to the channel CH1 and a sub-voice (BGM, effect sound, or the like) is assigned to the channel CH2. As a result, it is possible to perform effective voice area guidance through one speaker device.

Preferably, the ultrasonic transducer is an electrostatic ultrasonic transducer.

According to this structure, the electrostatic ultrasonic transducer is used as the ultrasonic transducer.

As a result, since the electrostatic transducer can generate a high sound pressure over a wide frequency band ranging from the ultrasonic frequency band to the audible frequency band, it is possible to reproduce both the sound having high directivity (super-directivity speaker) and the sound having low directivity (loudspeaker) with a high sound pressure. Accordingly, it is possible to realize the functions of the super-directivity speaker and the loudspeaker by using one electrostatic ultrasonic transducer.

According to a twelfth aspect of the invention, there is provided a speaker control device that drives an ultrasonic transducer so as to reproduce a signal sound. The speaker control device includes a carrier wave generating unit that generates an ultrasonic frequency band carrier wave, a modulating unit that modulates the ultrasonic frequency band carrier wave output by the carrier wave generating unit with an audible frequency band input signal, a level controller that controls a level ratio between a modulated wave output by the modulating unit and the audible frequency band input signal, and a mixer that mixes the modulated wave and the audible frequency band input signal whose levels are controlled by the level controller so as to generate a synthesis wave. The ultrasonic transducer is driven with the synthesis wave.

According to this structure, the carrier wave generating unit generates the ultrasonic frequency band carrier wave, and the modulating unit modulates the ultrasonic frequency band carrier wave output from the carrier wave generating unit with the audible frequency band input signal.

The level ratio between the modulated wave output from the modulating unit and the audible frequency band input signal is controlled by the level controller to the predetermined ratio, and the modulated wave whose level is controlled by the level controller and the audible frequency band signal are mixed by the mixer to generate the synthesis wave. The ultrasonic transducer is driven with the synthesis wave and the ultrasonic transducer reproduces the signal sound.

Accordingly, since the level controller controls the level ratio between the modulated wave and the audible frequency band input signal to the predetermined ratio, it is possible to change a directivity angle of the sound output from the ultrasonic transducer. That is, if the ratio of the modulated signal is increased, the directivity becomes higher, and when the ratio of the audible frequency band input signal is increased, the directivity becomes lower. For this reason, the level ratio between the modulated wave and the audible frequency band input signal is controlled such that the speaker device functions as a pure super-directivity speaker or a pure loudspeaker, thereby simultaneously realizing functions of the super-directivity speaker and the loudspeaker.

According to a thirteenth aspect of the invention, there is provided a speaker control device that drives an ultrasonic transducer so as to reproduce a signal sound. The speaker control device includes a carrier wave generating unit that generates an ultrasonic frequency band carrier wave, a modulating unit that modulates the ultrasonic frequency band carrier wave output by the carrier wave generating unit with an audible frequency band input signal, a phase shifter that shifts a phase of the audible frequency band input signal, a level controller that controls a level ratio between a modulated wave output by the modulating unit and the audible frequency band input signal whose phase is shifted by the phase shifter, a mixer that mixes the modulated wave and the audible frequency band input signal whose levels are controlled by the level controller so as to generate a synthesis wave, and the ultrasonic transducer is driven with the synthesis wave.

In the speaker control device of the aspect, the ultrasonic frequency band carrier wave is generated by the carrier wave generating unit and the ultrasonic frequency band carrier wave output from the carrier wave generating unit is modulated with an audible frequency band input signal by the modulating unit.

Further, the phase of the audible frequency band input signal is shifted by the phase shifter, and the level controller changes the level ratio between the modulated wave output from the modulating unit and the audible frequency band signal whose phase is shifted by the phase shifter. The mixer mixes the modulated wave and the audible frequency band signal whose levels are controlled by the level controller so as to synthesize the synthesis wave. The synthesis wave is amplified by the power amplifier, and the ultrasonic transducer is driven with the synthesis wave.

Accordingly, since the level controller controls the level ratio between the modulated wave and the audible frequency band input signal to the predetermined ratio, it is possible to change a directivity angle of the sound output from the ultrasonic transducer. In addition, after shifting the phase of the audible frequency band input signal mixed with the modulated wave, the modulated wave and the audible frequency band signal are mixed with each other, and thus positive and negative asymmetry in amplitude of the synthesis waveform is suppressed. For this reason, the load is reduced which is applied to the vibrating membrane or the driving circuit of the ultrasonic transducer, which lengthens a life span of a system.

According to a fourteenth aspect of the invention, there is provided a speaker control device that drives an ultrasonic transducer so as to reproduce a signal sound. The speaker control device includes a carrier wave generating unit that generates an ultrasonic frequency band carrier wave, a modulating unit that modulates the ultrasonic frequency band carrier wave output by the carrier wave generating unit with an audible frequency band input signal, a phase shifter that shifts a phase of the audible frequency band input signal by 90 degrees or approximately 90 degrees, a level controller that controls a level ratio between a modulated wave output by the modulating unit and the audible frequency band input signal whose phase is shifted by 90 degrees or approximately 90 degrees by the phase shifter, and a mixer that mixes the modulated wave and the audible frequency band input signal whose levels are controlled by the level controller so as to generate a synthesis wave. The ultrasonic transducer is driven with the synthesis wave.

According to this structure, the carrier wave generating unit generates the ultrasonic frequency band carrier wave, and the modulating unit modulates the ultrasonic frequency band carrier wave output from the carrier wave generating unit with the audible frequency band input signal.

Further, after the phase shifter shifts the phase of the audible frequency band input signal by 90 degrees (or approximately 90 degrees), the level controller controls a level ratio between the modulated wave output by the modulating unit and the audible frequency band input signal whose phase is shifted by 90 degrees by the phase shifter. The mixer mixes the modulated wave and the audible frequency band input signal whose levels are controlled by the level controller so as to generate a synthesis wave, and the ultrasonic transducer is driven with the synthesis wave so as to reproduce a signal sound.

Accordingly, according to this structure, since the level controller controls the level ratio between the modulated wave and the audible frequency band input signal to the predetermined ratio, it is possible to change a directivity angle of the sound output from the ultrasonic transducer. In addition, after shifting the phase of the audible frequency band input signal mixed with the modulated wave by 90 degrees (or approximately 90 degrees), the modulated wave and the audible frequency band signal are mixed with each other, and thus positive and negative asymmetry in amplitude of the synthesis waveform is suppressed. For this reason, the load is reduced which is applied to the vibrating membrane or the driving circuit of the ultrasonic transducer, which lengthens a life span of a system.

According to a fifteenth aspect of the invention, there is provided a speaker control device that drives an ultrasonic transducer so as to reproduce a signal sound. The speaker control device includes a carrier wave generating unit that generates an ultrasonic frequency band carrier wave, a first filter that receives an audible frequency band input signal and has a predetermined pass band characteristic, a modulating unit that modulates the ultrasonic frequency band carrier wave output by the carrier wave generating unit with an audible frequency band input signal that is an output signal of the first filter, a second filter that receives the audible frequency band input signal and has a different pass band characteristic from the first filter, a level controller that controls a level ratio between a modulated wave output by the modulating unit and the audible frequency band input signal that is an output signal of the second filter, and a mixer that mixes the modulated wave and the audible frequency band input signal whose levels are controlled by the level controller so as to generate a synthesis wave. The ultrasonic transducer is driven with the synthesis wave.

According to this structure, the carrier wave generating unit generates the ultrasonic frequency band carrier wave, the audible frequency band input signal is input to the first filter having the predetermined pass band characteristic, and the signal having the predetermined pass band is output. Further, the modulating unit modulates the ultrasonic frequency band carrier wave output by the carrier wave generating unit with the audible frequency band input signal that is the output signal of the first filter. Meanwhile, the audible frequency band input signal is input to the second filter having the different audible frequency band signal from the first filter, and the signal having the predetermined pass band is output. The level controller controls the level ratio between the modulated wave output by the modulating unit and the audible frequency band input signal being the output signal of the second filter to the predetermined ratio, and the mixer mixes the modulated wave and the audible frequency band signal whose levels are controlled by the level controller so as to generate a synthesis wave. The ultrasonic transducer is driven with the synthesis wave so as to reproduce the signal sound.

Accordingly, since the level controller controls the level ratio between the modulated wave and the audible frequency band input signal to the predetermined ratio, it is possible to change a directivity angle of the sound output from the ultrasonic transducer. Further, the second filter is composed of a high pass filter (HPF), and the cutoff frequency of the high pass filter in the frequency characteristic is changed, which changes directivity of the reproduced sound. Furthermore, the first filter is composed of an equalization filter that equalizes a frequency characteristic of a demodulated sound or an inverse filter that suppresses unnecessary intermodulation distortion at the time of self-demodulation, so as to form a filter having a frequency characteristic of improving a sound quality of a beam sound, or making up for or emphasizing the audible band signal having passed through the second filter, such that the sound effect can be further improved.

According to a sixteenth aspect of the invention, there is provided a speaker control device that drives an ultrasonic transducer so as to reproduce a signal sound. The speaker control device includes a carrier wave generating unit that generates an ultrasonic frequency band carrier wave, a first filter that receives an audible frequency band input signal and has a predetermined pass band characteristic, a phase shifter that shifts a phase of the audible frequency band input signal by 90 degrees or approximately 90 degrees, a modulating unit that modulates the ultrasonic frequency band carrier wave output by the carrier wave generating unit with the audible frequency band input signal that is an output signal of the first filter, a second filter that receives the audible frequency band input signal being an output signal of the phase shifter and has a different pass band characteristic from the first filter, a level controller that controls a level ratio between a modulated wave output by the modulating unit and the audible frequency band input signal that is an output signal of the second filter, and a mixer that mixes the modulated wave and the audible frequency band input signal whose levels are controlled by the level controller so as to generate a synthesis wave. The ultrasonic transducer is driven with the synthesis wave.

According to this structure, the carrier wave generating unit generates the ultrasonic frequency band carrier wave, the audible frequency band input signal is input to the first filter having the predetermined pass band characteristic, and the signal having the predetermined pass band is output.

Meanwhile, the phase shifter shifts the phase of the audible frequency band input signal by 90 degrees (or approximately 90 degrees) and is then input to the second filter having the different frequency characteristic from the first filter, and the signal having the predetermined pass band is output through the second filter.

Further, the modulating unit modulates the ultrasonic frequency band carrier wave output by the carrier wave generating unit with the audible frequency band input signal that is the output signal of the first filter. The level controller controls the level ratio between the modulated wave output by the modulating unit and the audible frequency band input signal being the output signal of the second filter to the predetermined ratio, and the mixer mixes the modulated wave and the audible frequency band signal whose levels are controlled by the level controller so as to generate a synthesis wave. The ultrasonic transducer is driven with the synthesis wave so as to reproduce the signal sound.

Accordingly, according to this structure, since the level controller controls the level ratio between the modulated wave and the audible frequency band input signal to the predetermined ratio, it is possible to change a directivity angle of the sound output from the ultrasonic transducer. In addition, after shifting the phase of the audible frequency band input signal mixed with the modulated wave by 90 degrees (or approximately 90 degrees), the modulated wave and the audible frequency band signal are mixed with each other, and thus positive and negative asymmetry in amplitude of the synthesis waveform is suppressed. For this reason, the load is reduced which is applied to the vibrating membrane or the driving circuit of the ultrasonic transducer, which lengthens a life span of a system.

Further, the second filter is composed of a high pass filter (HPF), and the cutoff frequency of the high pass filter in the frequency characteristic is changed, which changes directivity of the reproduced sound. As a result, it is possible to minutely control the directivity.

Furthermore, the first filter is composed of an equalization filter that equalizes a frequency characteristic of a demodulated sound or an inverse filter that suppresses unnecessary intermodulation distortion at the time of self-demodulation, so as to form a filter having a frequency characteristic of improving a sound quality of a beam sound, or making up for or emphasizing the audible band signal having passed through the second filter, such that the sound effect can be further improved.

Preferably, the second filter has a pass band characteristic of a high pass filter, and a cutoff frequency of the high pass filter in the pass band characteristic is controlled.

According to this structure, the second filter is composed of a high pass filter (HPF), and the cutoff frequency of the high pass filter in the frequency characteristic is changed, which changes directivity of the reproduced sound. As a result, it is possible to minutely control the directivity.

Preferably, the first filter is composed of an equalization filter that has a frequency characteristic of equalizing a frequency characteristic of a demodulated sound.

According to this structure, it is possible to equalize the frequency characteristic of the demodulated sound, and to improve the sound quality of the beam sound that is the sound output.

Preferably, the speaker control device according to the seventeenth aspect of the invention further includes a third filter that is inserted between the second filter and the level controller and has a different pass band characteristic from the second filter.

According to this structure, the third filter is inserted between the second filter and the level controller. For example, the third filter has a pass characteristic that becomes a characteristic opposite to an output characteristic (attenuation characteristic) of the transducer in the audible frequency band.

Accordingly, the frequency characteristic of the direct sound finally output from the transducer (signal component of an audible frequency band reproduced through the second filter and the third filter) can be equalized. For this reason, the reproducing balance of the direct sound (sound having low directivity) that is output from the transducer is kept, and the sound quality can be prevented from being deteriorated.

Preferably, the third filter has a frequency characteristic of equalizing an overall output characteristic or a partial output characteristic of the ultrasonic transducer in the audible frequency band.

According to this structure, the third filter is inserted between the second filter and the level controller. The third filter has a frequency characteristic of equalizing an overall output characteristic or a partial output characteristic of the ultrasonic transducer in the audible frequency band.

Accordingly, the frequency characteristic of the direct sound finally output from the transducer (signal component of an audible frequency band reproduced through the second filter and the third filter) can be equalized. For this reason, the reproducing balance of the direct sound (sound having low directivity) that is output from the transducer is kept, and the sound quality can be prevented from being deteriorated.

Preferably, the speaker device according to the seventeenth aspect of the invention further includes a first signal input terminal that receives a first audible frequency band signal output as a sound having high directivity, and a second signal input terminal that receives a second audible frequency band signal output as a sound having low directivity. The first audible frequency band signal is supplied to the modulating unit from the first signal input terminal, and the second audible frequency band signal is supplied to the level controller from the second signal input terminal.

According to this structure, the first audible frequency band signal output as a sound having high directivity is input through the first signal input terminal, and the second audible frequency band signal output as a sound having low directivity is input through the second signal input terminal. The first audible frequency band signal is supplied to the modulating unit, and the modulating unit modulates the ultrasonic frequency band carrier wave with the first audible frequency band signal.

Further, the level controller controls the level ratio between the modulated wave being the output of the modulating unit and the second audible frequency band signal, and the mixer mixes the modulated wave and the second audible frequency band signal. The ultrasonic transducer is driven with the synthesis wave so as to reproduce the signal sound.

As such, the channel CH1 outputting the signal as the sound having high directivity is separated from the channel CH2 outputting the signal as the sound having low directivity, and the synthesis wave obtained by mixing the signals is reproduced. By using this structure, a main voice (main vocal or sound announce) is assigned to the channel CH1 and a sub-voice (BGM, effect sound, or the like) is assigned to the channel CH2. As a result, it is possible to perform effective voice area guidance through one speaker device.

Preferably, the ultrasonic transducer is an electrostatic ultrasonic transducer.

According to this structure, the ultrasonic transducer is composed of an electrostatic ultrasonic transducer.

Since the electrostatic transducer can generate a high sound pressure over a wide frequency band ranging from the ultrasonic frequency band to the audible frequency band, it is possible to reproduce both the sound having high directivity (super-directivity speaker) and the sound having low directivity (loudspeaker) with a high sound pressure. Accordingly, it is possible to realize the functions of the super-directivity speaker and the loudspeaker by using one electrostatic ultrasonic transducer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the preferred embodiments of the invention will be described with reference to the accompanying drawings. A speaker device according to embodiments of the invention mixes a signal wave in an audible frequency band and a modulated wave obtained by modulating a carrier wave in an ultrasonic frequency band with an audible frequency band signal so as to generate a synthesis wave, and drives an ultrasonic transducer with the synthesis wave so as to reproduce a signal sound. According to the embodiments of the invention, the modulated wave in the ultrasonic frequency band and the audible frequency band signal are simultaneously generated by one ultrasonic transducer, which obtains a hybrid speaker device that is capable of realizing a super-directivity speaker (ultrasonic speaker) and a loudspeaker with one ultrasonic transducer.

First Embodiment

Figure 1:
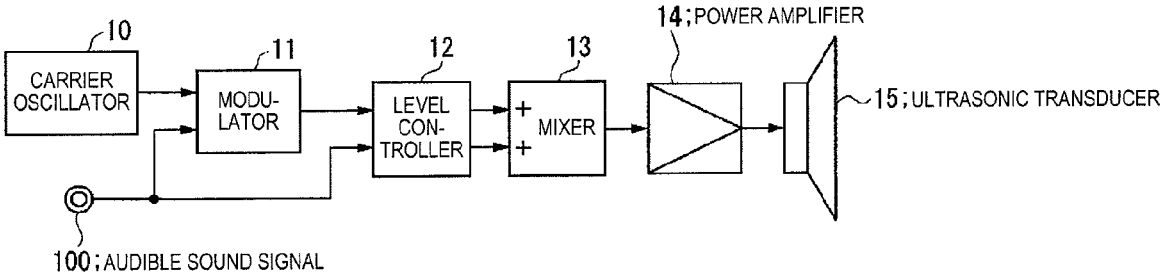
FIG. 1 is a block diagram illustrating a structure of a speaker device according to a first embodiment of the invention.

FIG. 1 shows a structure of a speaker device according to a first embodiment of the invention. In FIG. 1, the speaker device according to the first embodiment of the invention includes a carrier oscillator 10, a modulator 11, a level controller 12, a mixer 13, a power amplifier 14, and an ultrasonic transducer 15.

The carrier oscillator 10 has a function of generating an ultrasonic frequency band carrier wave.

The modulator 11 has a function of modulating the ultrasonic frequency band carrier wave output by the carrier oscillator 10 with an audible frequency band input signal (audible sound signal).

In the present specification, each of the 'ultrasonic frequency band' and the 'ultrasonic wave band' means a frequency band of 20 KHz or more, and each of the 'audible frequency band' and the 'audible band' means a frequency band of less than 20 KHz.

The level controller 12 has a function of controlling a level ratio between the modulated wave output by the modulator 11 and the audible frequency band input signal.

The mixer 13 has a function of mixing the modulated wave and the audible frequency band signal whose levels are controlled by the level controller 12 so as to generate a synthesis wave.

The power amplifier 14 has a function of amplifying the output of the mixer 13 to a predetermined level.

The ultrasonic transducer 15 is driven by the synthesis wave and reproduces a signal sound.

The carrier oscillator 10 corresponds to a carrier wave generating unit according to an aspect of the invention, the modulator 11 corresponds to a modulating unit according to the invention, and the level controller 12 corresponds to a level controller according to the invention. Further, in the speaker device according to the first embodiment of the invention shown in FIG. 1, a portion composed of the carrier oscillator 10, the modulator 11, the level controller 12, and the mixer 13 corresponds to the speaker control device according to the embodiment of the invention.

In this structure, the ultrasonic frequency band carrier wave is generated by the carrier oscillator 10, and is input to one input terminal of the modulator 11. Further, the audible frequency band signal, for example, an audible sound signal serving as an announcement source or a music source is input to the other input terminal of the modulator 11 through a signal input terminal 100.

The modulator 11 modulates the ultrasonic frequency band carrier wave output by the carrier oscillator 10 with the audible sound signal having been input through the signal input terminal 100, and outputs the modulated wave to one input terminal of the level controller 12. Further, the audible sound signal is input to the other input terminal of the level controller 12 from the signal input terminal 100.

The level controller 12 controls a level ratio between the modulated wave output by the modulator 11 and the audible frequency band input signal to a predetermined ratio.

The mixer 13 mixes the modulated wave and the audible frequency band signal whose levels are controlled by the level controller 12 so as to generate a synthesis wave. The ultrasonic transducer 15 is driven with the synthesis wave, and reproduces a signal sound.

Therefore, in the speaker device according to the first embodiment of the invention, since the level controller 12 controls the level ratio between the modulated wave and the audible frequency band input signal to the predetermined ratio, it is possible to change a directivity angle of the sound output of the ultrasonic transducer 15. That is, when the ratio of the modulated signal is increased, directivity becomes higher, and when the ratio of the audible frequency band input signal is increased, directivity becomes lower. For this reason, the level ratio between the modulated wave and the audible frequency band input signal is controlled such that the speaker device functions as a pure super-directivity speaker or a pure loudspeaker, thereby simultaneously realizing functions of the super-directivity speaker and the loudspeaker.

Figure 2A:
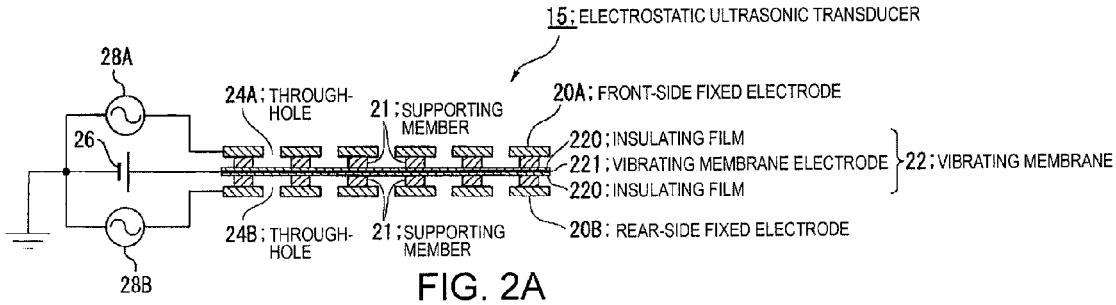
FIGS. 2A to 2C are diagrams illustrating an example of a structure of an electrostatic ultrasonic transducer that is suitable for an ultrasonic transducer in a speaker device according to embodiments of the invention.
Figure 2B:
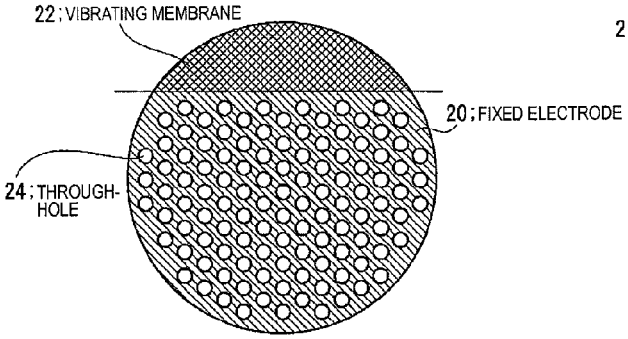
Figure 2C:
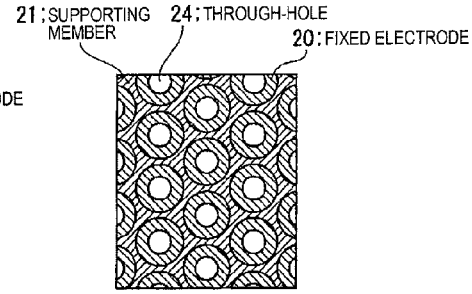

FIGS. 2A to 2C show an example of a structure of an electrostatic ultrasonic transducer that is suitable for an ultrasonic transducer according to the embodiments of the invention.

FIG. 2A shows a section of the electrostatic ultrasonic transducer 15. In FIG. 2A, the electrostatic ultrasonic transducer 15 includes a vibrating membrane 22 that has a conductive layer 221 (vibrating membrane electrode), and a pair of fixed electrodes (referred to as a fixed electrode 20 when indicating both a front-side fixed electrode 20A and a rear-side fixed electrode 20B) that is provided to face surfaces of the vibrating membrane 22 and is composed of the front-side fixed electrode 20A and the rear-side fixed electrode 20B. As shown in FIG. 2A, the vibrating membrane 22 may be constructed such that the conductive layer 221 (vibrating membrane electrode) for forming the electrode is interposed between the insulating layers 220, or may be constructed such that the entire vibrating membrane is formed of a conductive material.

Further, in the front-side fixed electrode 20A that interposes the vibrating membrane 22 together with the rear-side fixed electrode 20B, a plurality of through-holes 24A are provided, and in the rear-side fixed electrode 20B, a plurality of through-holes 24B having the same shape as the plurality of through-holes 24A are provided at locations that face the through-holes 24A provided in the front-side fixed electrode 20A (in this case, the through-hole 24A and the through-hole 24B are referred to as a through-hole 24 when indicating both the through-hole 24A and the through-hole 24B). The front-side fixed electrode 20A and the rear-side fixed electrode 20B are supported by a supporting member 21 with a predetermined gap from the vibrating membrane 22. As shown in FIG. 2A, the supporting member is formed such that portions of the vibrating membrane 22 and the fixed electrode 20 face each other with a gap interposed therebetween. FIG. 2B shows an outer shape of one-side plane of an electrostatic ultrasonic transducer 15 (state where a portion of the fixed electrode 20 is notched). Therefore, in FIG. 2B, the plurality of through-holes 24 are provided in a honeycomb shape. FIG. 2C is a plan view of the fixed electrode to which the supporting member is bonded, and shows a state of when the fixed electrode 20 is viewed from the side of the vibrating membrane 22 of the electrostatic ultrasonic transducer. The supporting member 21 is formed of an insulating material. For example, the supporting member 21 can be formed by patterning the insulating material on a surface of the fixed electrode 20 (side of the fixed electrode 20 facing the vibrating membrane 22) in such a manner that resist is printed on a printed circuit board.

By the above-described structure, the front-side fixed electrode 20A and the rear-side fixed electrode 20B of the electrostatic ultrasonic transducer 15 are respectively applied with alternating current signals 28A and 28B in which amplitudes are the same but phases are inverted. Further, a direct current power supply 26 applies a direct current bias voltage to the vibrating membrane electrode 221. As such, the direct current bias voltage is applied to the vibrating membrane electrode 221, and the driving signals (alternating current signals) whose phases are inverted are applied to the front-side fixed electrode 20A and the rear-side fixed electrode 20B. As a result, an electrostatic attractive force and an electrostatic repulsive force are simultaneously applied to the vibrating membrane 22 in the same direction. Whenever the polarities of the driving signals (alternating current signals) are inverted, directions where the electrostatic attractive force and the electrostatic repulsive force are applied are changed, and the vibrating membrane 22 is driven in a push-pull manner. As a result, a sound wave that is generated by the vibrating membrane is discharged to the outside through the through-holes 24 that are provided in the front-side fixed electrode 20A and the rear-side fixed electrode 20B.

Figure 3:
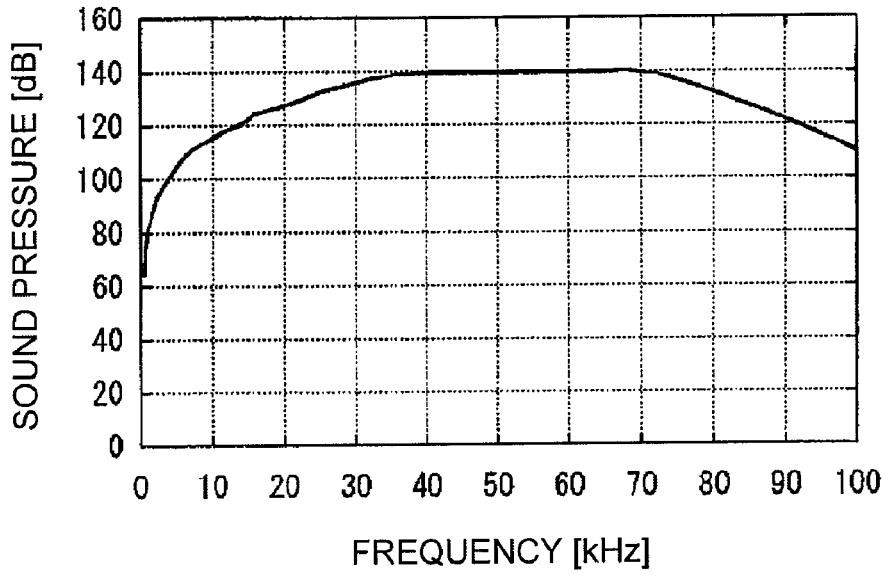
FIG. 3 is a characteristic view illustrating an example of an output sound pressure/frequency characteristic of an electrostatic ultrasonic transducer.

As shown in FIG. 3, the above-described electrostatic transducer has a wide band sound pressure/frequency characteristic in an ultrasonic frequency band. In addition, different from a piezoelectric ultrasonic transducer, a frequency characteristic is not sharply changed in the electrostatic ultrasonic transducer, and the electrostatic ultrasonic transducer has some sound pressure sensitivity even in an audible frequency band, as shown in FIG. 3. For this reason, if the audible frequency band signal is directly input to the electrostatic ultrasonic transducer, the electrostatic ultrasonic transducer can function as a loudspeaker that directly radiates the audible frequency band sound.

Figure 4:
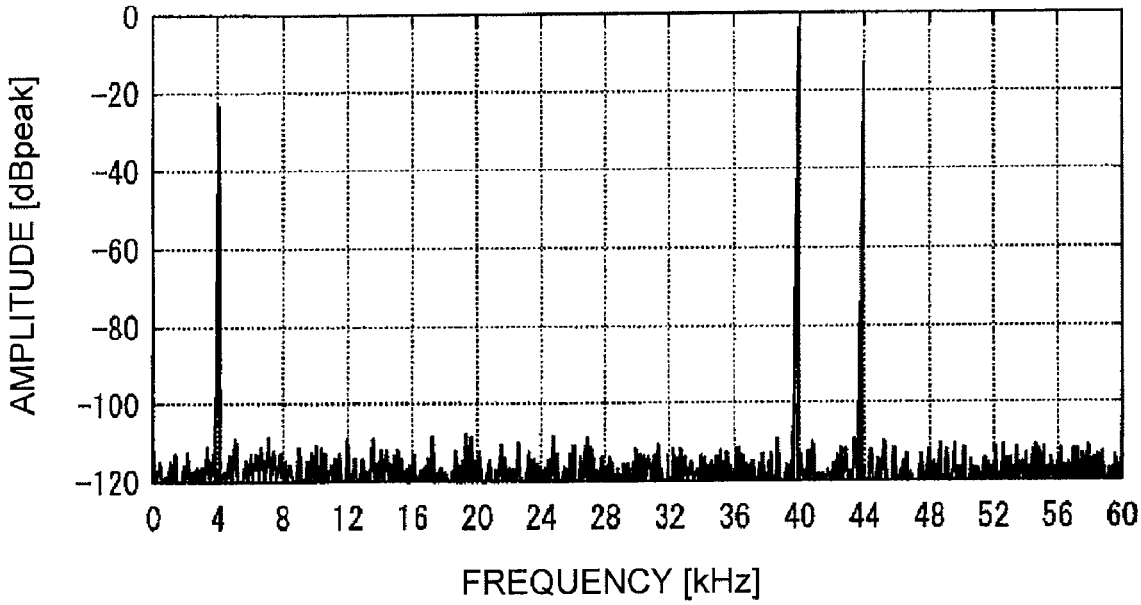
FIG. 4 is a diagram illustrating an example of a frequency spectrum of a synthesis wave of a modulated wave signal and an audible frequency band signal.

FIG. 4 shows an example of a frequency spectrum of a synthesis wave that is obtained by mixing the carrier wave and the audible frequency band signal when the carrier wave is a sine wave signal of 40 KHz and the audible frequency band signal is a sine wave signal of 4 KHz, and drives the electrostatic ultrasonic transducer. In this case, the modulation ratio is 50%, and the synthesis level ratio between the modulated wave and the audible sound signal is 10:4. However, the numerical values are parameters that vary according to a desired producing sound volume or directivity angle, and are not limited to the specific values.

Further, the modulation method is SSB-WC (Single Side Band with Carrier) modulation.

Figure 5:
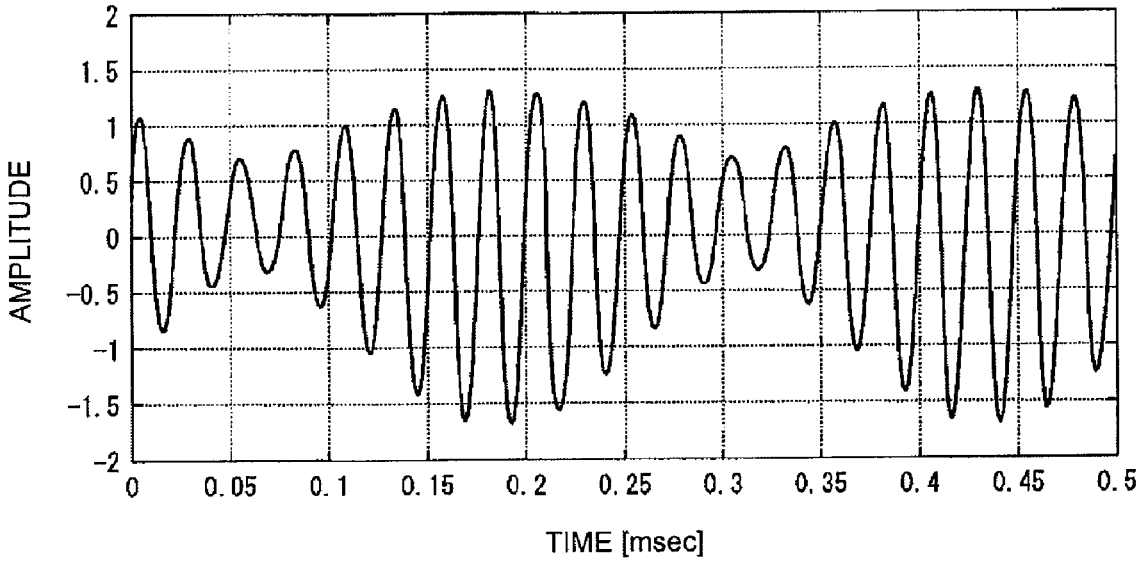
FIG. 5 is a diagram illustrating an example of a synthesis waveform of a modulated wave signal and an audible frequency band signal.

In FIG. 4, it can be understood that modulated wave spectrum components of 40 KHz and 44 KHz are raised in an ultrasonic frequency band, and an audible frequency band signal component of 4 KHz is also raised. FIG. 5 shows an example of a signal waveform of a synthesis wave that has the spectrum shown in FIG. 4.

If the synthesis wave is output from the electrostatic ultrasonic transducer through a power amplifier, in the examples shown in FIGS. 4 and 5, in the (strong) sound waves of 40 KHz and 44 KHz that are frequency components in an ultrasonic wave band, the sound waves propagate the air due to non-linearity of the air, and thus distortion is accumulated. As a result, an audible sound of 4 KHz that is a difference tone component between the frequency components of 40 KHz and 44 KHz is self-demodulated (reproduced) having high directivity (This effect is called parametric array effect). At the same time, the sound wave of 4 KHz that is the audible frequency band component is output directly from the electrostatic ultrasonic transducer. As a result, the audible sound of 4 KHz having low directivity is also reproduced.

The level controller 12 of the speaker device shown in FIG. 1 controls a level of a modulated signal (40 KHz+44 KHz) and a level of the audible frequency band signal (4 KHz), and thus a directivity angle can be changed. In this case, if a ratio of the modulated signal is increased, the directivity becomes higher, and if a ratio of the audible frequency band signal is increased, the directivity becomes lower. If a synthesis level ratio between the modulated wave signal and the audible frequency band signal is 10:0, the speaker device functions as a pure super-directivity speaker. If the synthesis level ratio between the modulated wave signal and the audible frequency band signal is 0:10, the speaker device functions as a pure loudspeaker.

Second Embodiment

Meanwhile, in the example of the synthesis waveform shown in FIG. 5, it can be understood that the positive and negative asymmetry of the amplitude is increased due to the modulated wave signal being mixed with the audible frequency band signal. If the level of the mixed audible frequency band signal is increased and becomes approximately a level of the modulated wave signal, the positive and negative asymmetry of the amplitude is increased. If the positive and negative asymmetry of the amplitude is increased, since vibration offset (deviation of the vibration) of the electrostatic ultrasonic transducer is increased, a load (damage) applied to a membrane or circuit is increased, which lowers the reliability of a system.

Accordingly, in the speaker device according to the second embodiment of the invention, after shifting the phase of the audible frequency band signal by 90 degrees, the audible frequency band signal is mixed with the modulated waveform, which suppresses the positive and negative asymmetry in amplitude of the synthesis wave. Further, it is preferable that the angle at which the phase is shifted be accurately 90 degrees. Even if the angle at which the phase is shifted is approximately 90 degrees, the above-described effect can be sufficiently obtained.

Figure 6:
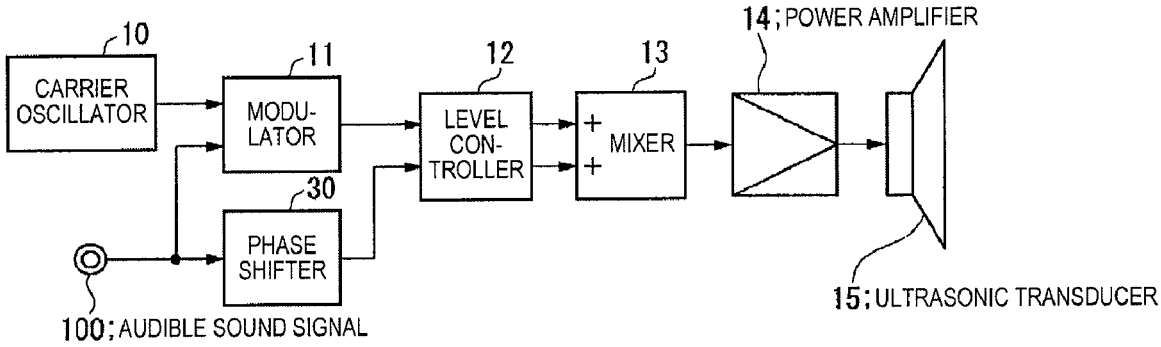
FIG. 6 is a block diagram illustrating a structure of a speaker device according to a second embodiment of the invention.

FIG. 6 shows a structure of the speaker device according to the second embodiment of the invention. In FIG. 6, the same constituent elements as those in the first embodiment are denoted by the same reference numerals. In FIG. 6, the speaker device according to the second embodiment of the invention includes a carrier oscillator 10 that generates an ultrasonic frequency band carrier wave, a modulator 11 that modulates the ultrasonic frequency band carrier wave output by the carrier oscillator 10 with an audible frequency band input signal, a phase shifter 30 that shifts a phase of the audible frequency band input signal by 90 degrees, a level controller 12 that controls a level ratio between the modulated wave output by the modulator 11 and the audible frequency band signal whose phase is shifted by 90 degrees by the phase shifter 30, a mixer 13 that mixes the modulated wave and the audible frequency band signal whose levels are controlled by the level controller 12 so as to generate a synthesis wave, a power amplifier 14 that amplifies the output of the mixer 13 to a predetermined level, and an ultrasonic transducer 15 that is driven by the synthesis wave output by the power amplifier 14 and reproduces a signal sound. Further, in the speaker device according to the second embodiment of the invention shown in FIG. 6, a portion composed of the carrier oscillator 10, the modulator 11, the phase shifter 30, the level controller 12, and the mixer 13 corresponds to the speaker control device according to the invention.

In this structure, the ultrasonic frequency band carrier wave is generated by the carrier oscillator 10, and is input to one input terminal of the modulator 11. Further, the audible frequency band signal, for example, an audible sound signal serving as an announcement source or a music source is input to the other input terminal of the modulator 11 through a signal input terminal 100 and the phase shifter 30. The audible frequency band input signal whose phase is shifted by 90 degrees by the phase shifter 30 is input to the other input terminal of the level controller 12.

Meanwhile, the modulator 11 modulates the ultrasonic frequency band carrier wave output by the carrier oscillator 10 with the audible sound signal having been input through the signal input terminal 100, and outputs the modulated wave to one input terminal of the level controller 12.

The level controller 12 controls a level ratio between the modulated wave output by the modulator 11 and the audible frequency band input signal, which is output by the phase shifter 30 and whose phase is shifted by 90 degrees, to a predetermined ratio.

The mixer 13 mixes the modulated wave and the audible frequency band signal whose levels are controlled by the level controller 12 so as to generate a synthesis wave. The synthesis wave is amplified to the predetermined level by the power amplifier 14, and is output to the ultrasonic transducer 15. The ultrasonic transducer 15 is driven with the synthesis wave, and reproduces a signal sound.

Figure 7:
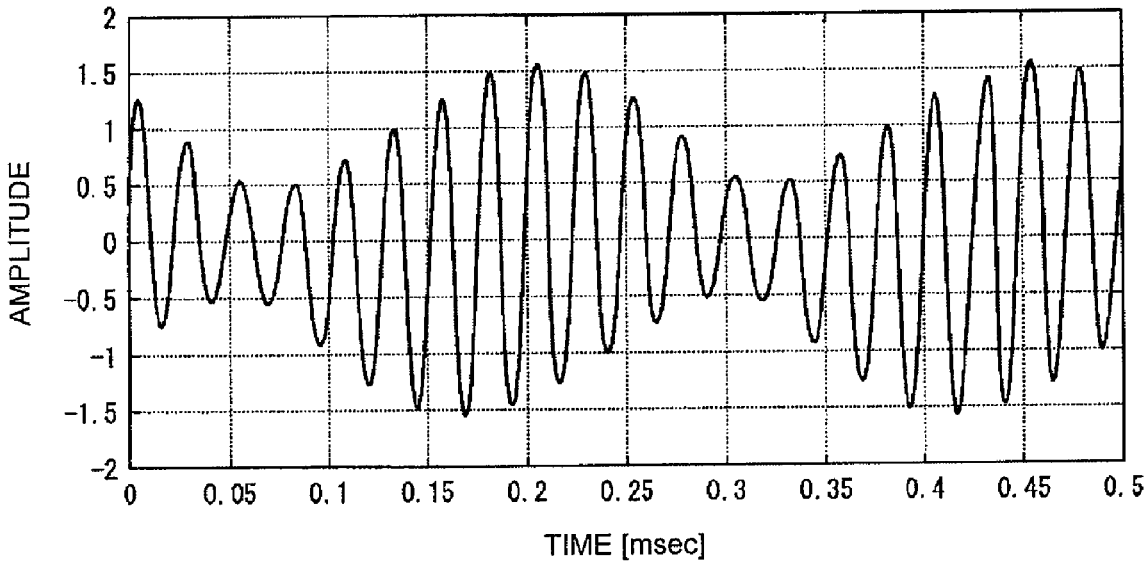
FIG. 7 is a diagram illustrating another example of a synthesis waveform of a modulated wave signal and an audible frequency band signal.

FIG. 7 shows an example of a waveform of a synthesis wave that is obtained by mixing an audible frequency band signal (4 KHz) and a modulated waveform after the phase of the audible frequency band signal is shifted by 90 degrees. A phase is not shifted in an audible frequency band signal used when the carrier wave is modulated by the modulator 11.

The positive and negative asymmetry of the amplitude appears in the example of the synthesis waveform shown in FIG. 5. However, in the example of the synthesis waveform shown in FIG. 7, the positive and negative asymmetry of the amplitude is suppressed by shifting the phase of the audible frequency band signal whose level is controlled by the level controller 12. That is, the load applied to the membrane or circuit can be reduced, which lengthens a life span of a system.

In this case, if the phase of the audible frequency band signal whose level is controlled by the level controller 12 is shifted by 90 degrees, the waveform of the synthesis wave mixed by the mixer 13 becomes positive and negative symmetry (amplitudes of the positive and negative envelop curves of the synthesis waveform become equal). This reason will be described with reference to FIGS. 11 to 14.

Figure 11:
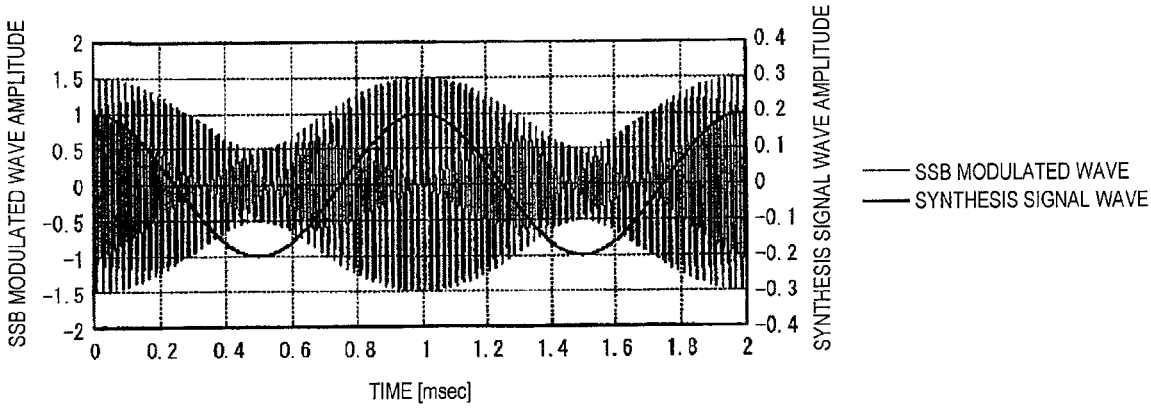
FIG. 11 is a diagram illustrating an example of a phase relationship between an SSB modulated waveform and an audible frequency band signal wave mixed with the SSB modulated waveform.

FIG. 11 shows a relationship between a modulated waveform (thin line) and an audible sound signal (thick line) mixed with the modulated waveform, in the mixer 13 of the speaker device according to the first embodiment shown in FIG. 1. As shown in FIG. 1, when the audible sound signal is mixed with the modulated wave in a state where the phase of the audible sound signal is not shifted, the phase of the envelope curve (peak) of the modulated waveform and the phase of the audible sound signal (peak) are the same, as shown in FIG. 11.

In this case, the modulation method is SSB-WC (Single Side Band with Carrier) modulation, and frequencies of a carrier wave and a signal wave at the time of modulation are 50 KHz and 1 KHz, respectively.

Figure 12:
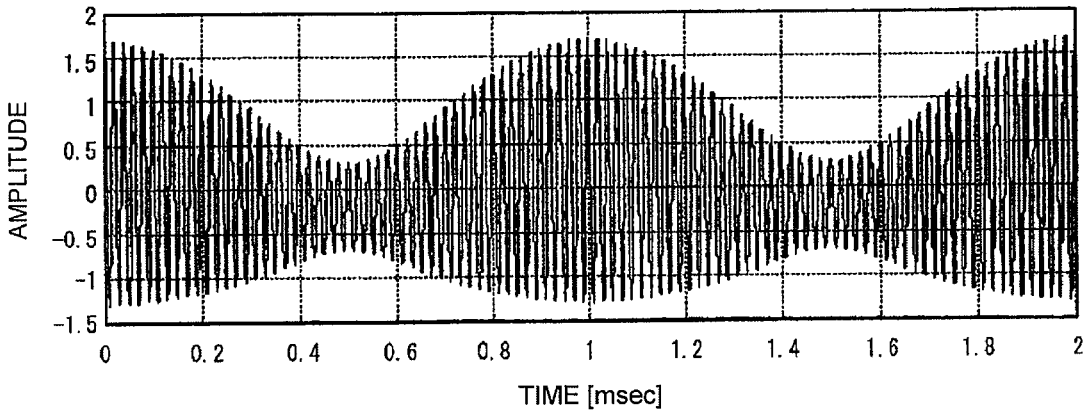
FIG. 12 is a diagram illustrating a waveform that is obtained by mixing an SSB modulated waveform and an audible frequency band signal waveform in FIG. 11.

FIG. 12 shows a waveform of a synthesis wave that is obtained by mixing the modulated wave and the audible sound signal shown in FIG. 11. As shown in FIG. 12, it can be understood that in the waveform of the synthesis wave obtained by mixing the modulated wave and the audible sound signal, amplitudes of positive and negative envelope curves are asymmetrical. This reason will be described in detail later.

As shown in FIG. 11, if the phase of the envelope curve waveform of the modulated wave and the phase of the audible sound signal waveform mixed with the modulated wave are the same, the location of the point-symmetrical center of the waveform that is surrounded by the envelope curves of the modulated waveform is different from the location of the point-symmetrical center of the waveform of the audible sound signal. In the example shown in FIG. 11, the point symmetrical center of the waveform (thin line) that is surrounded by the envelope curves is at a location of 1 msec, while the point symmetrical center of the audible sound signal waveform (thick line) is at a location of 0.75 msec. As a result, the waveform that is obtained by mixing the modulated wave and the audible sound signal waveform may become a waveform line-symmetrical to the amplitude axis, but does not become a waveform point-symmetrical to the amplitude axis, as shown in FIG. 12. Accordingly, the maximum amplitudes of the positive and negative envelope curves may be different from each other (that is, they may not be symmetrical to each other).

Figure 13:
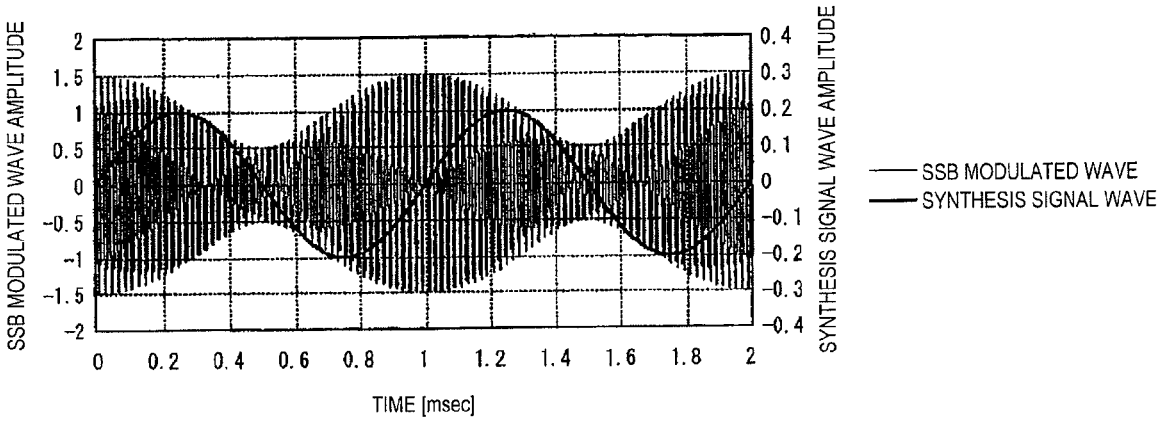
FIG. 13 is a diagram illustrating another example of a phase relationship between an SSB modulated waveform and an audible frequency band signal waveform mixed with the SSB modulated waveform.

Meanwhile, FIG. 13 shows a relationship between a modulated waveform (thin line) input to the mixer 13 of the speaker device according to the second embodiment shown in FIG. 6 and an audible sound signal (thick line) mixed with the modulated waveform. As shown in FIG. 6, when the modulated waveform and the audible sound signal are mixed with each other after the phase of the audible sound signal is shifted by 90 degrees, the phase of the envelope curve (peak) of the modulated waveform and the phase of the audible sound signal (peak) become deviate with each other by 90 degrees.

Figure 14:
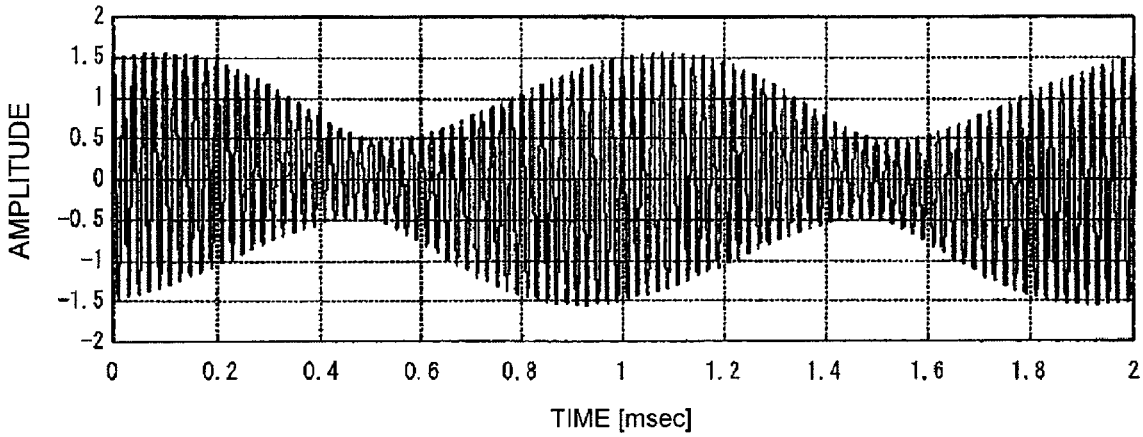
FIG. 14 is a diagram illustrating a waveform that is obtained by mixing an SSB modulated waveform and an audible frequency band signal waveform in FIG. 13.

FIG. 14 shows a waveform that is obtained by mixing the audible sound signal and the modulated waveform shown in FIG. 13. As shown in FIG. 14, it can be understood that in the waveform obtained by mixing the modulated waveform and the audible sound signal, the maximum amplitudes of the positive and negative envelope curves becomes symmetrical to each other. That is, as shown in FIG. 13, if the phase of the envelope curve waveform of the modulated wave and the phase of the waveform of the audible sound signal mixed with the modulated wave deviate with each other by 90 degrees, the point-symmetrical center of the waveform that is surrounded by envelope curves of the modulated wave and the point-symmetrical center of the audible sound signal are the same. In the example shown in FIG. 13, both the point-symmetrical center of the waveform (thin line) surrounded by the envelope curves and the point-symmetrical center of the audible sound signal waveform (thick line) are at a location of 1 msec. As a result, as shown in FIG. 14, the waveform of the synthesis signal that is obtained by mixing the modulated wave and the audible sound signal becomes a waveform point-symmetrical (to the point-symmetrical center of 1 msec), as shown in FIG. 14. Accordingly, the waveform of the synthesis signal may not become a waveform line-symmetrical to the amplitude axis, but the maximum amplitudes of the positive and negative envelope curves become the same. As such, when an amount of shifted phase is 0 degree, positive and negative asymmetry becomes maximized, and when the amount of shifted phase is approximately 90 degrees, the positive and negative asymmetry becomes minimized.

As described above, in the waveform of the synthesis wave that is obtained by mixing the modulated wave and the audible sound signal wave, in order to make the maximum amplitudes of the positive and negative envelope curves the same so as to obtain the positive and negative symmetry, the modulated wave and the audible sound signal may be mixed with each other after the phase of the audible sound signal is shifted by 90 degrees.

As described above, according to the speaker device according to the second embodiment of the invention that has the above-described structure, since the level controller 12 control the level ratio between the modulated wave and the audible frequency band input signal to the predetermined ratio, it is possible to change a directivity angle of the sound output of the ultrasonic transducer. In addition, after shifting the phase of the audible frequency band signal mixed with the modulated wave by 90 degrees, the modulated wave and the audible frequency band signal are mixed with each other, and thus it is possible to suppress positive and negative asymmetry in amplitude of the synthesis waveform. For this reason, the load is reduced which is applied to the vibrating membrane or the driving circuit of the ultrasonic transducer, which lengthens a life span of a system.

Third Embodiment

Figure 8:
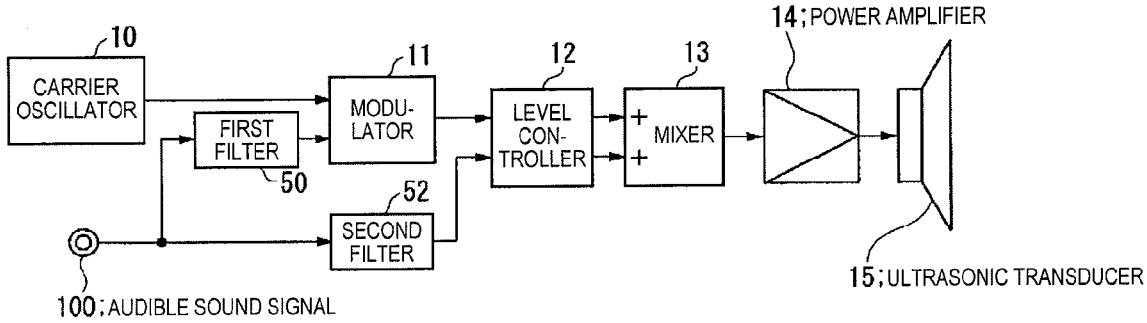
FIG. 8 is a block diagram illustrating a structure of a speaker device according to a third embodiment of the invention.

FIG. 8 shows a structure of a speaker device according to a third embodiment of the invention. The speaker device according to the third embodiment of the invention is different from the speaker device according to the first embodiment of the invention in that an audible frequency band input signal is input to a modulator through a first filter having a predetermined pass band characteristic, and the audible frequency band input signal is input to a level controller through a second filter having a different pass band characteristic from the first filter. Since the other structure is the same as the structure of the speaker device according to the first embodiment, the same constituent elements as those in the first embodiment are denoted by the same reference numerals, and the repetitive description will be omitted.

In FIG. 8, the speaker device according to the third embodiment of the invention includes a carrier oscillator 10 that generates an ultrasonic frequency band carrier wave, a first filter 50 that receives the audible frequency band input signal and has the predetermined pass band characteristic, a modulator 11 that modulates the ultrasonic frequency band carrier wave output by the carrier oscillator 10 with an audible frequency band input signal that is an output signal of the first filter 50, a second filter 52 that receives the audible frequency band input signal and has the different pass band characteristic from the first filter 50, a level controller 12 that controls a level ratio between the modulated wave output by the modulator 11 and the audible frequency band signal that is the output signal of the second filter 52, a mixer 13 that mixes the modulated wave and the audible frequency band signal whose levels are controlled by the level controller 12 so as to generate a synthesis wave, a power amplifier 14 that amplifies the output of the mixer 13 to a predetermined level, and an ultrasonic transducer 15 that is driven by the synthesis wave output by the power amplifier 14 and reproduces a signal sound. Further, in the speaker device according to the third embodiment of the invention shown in FIG. 8, a portion composed of the carrier oscillator 10, the first filter 50, the modulator 11, the second filter 52, the level controller 12, and the mixer 13 corresponds to the speaker control device according to the invention.

In the speaker device according to the third embodiment of the invention that has the above-described structure, the ultrasonic frequency band carrier wave is generated by the carrier oscillator 10, and is input to one input terminal of the modulator 11.

Further, the audible frequency band input signal is input to the first filter 50 having the predetermined pass band characteristic from the signal input terminal 100, and the signal having the predetermined pass band is output from the first filter 50, and the output signal is input to the other input terminal of the modulator 11.

The modulator 11 modulates the ultrasonic frequency band carrier wave output by the carrier oscillator 10 with the audible frequency band signal that is the output signal of the first filter 50, and the modulated wave output by the modulator 11 is input to one input terminal of the level controller 12.

Meanwhile, the audible frequency band input signal is input to the second filter 52, which has the different pass band characteristic from the first filter 50, from the signal input terminal 100, the signal having the predetermined pass band characteristic is output from the second filter 52, and the output signal is input to the other input terminal of the level controller 12.

The level controller 12 controls a level ratio between the modulated wave output by the modulator 11 and the audible frequency band input signal that is the output signal of the second filter 52 to a predetermined ratio (set value).

The mixer 13 mixes the modulated wave and the audible frequency band signal whose levels are controlled by the level controller 12 so as to generate a synthesis wave. The synthesis wave is amplified to the predetermined level by the power amplifier 14, and is output to the ultrasonic transducer 15. The ultrasonic transducer 15 is driven with the output of the power amplifier 14, and reproduces a signal sound.

In the speaker device according to the third embodiment of the invention, since the level controller 12 controls the level ratio between the modulated wave and the audible frequency band input signal to the predetermined ratio, it is possible to change a directivity angle of the sound output of the ultrasonic transducer.

Further, the second filter 52 is composed of a high pass filter (HPF). In addition, a cutoff frequency of the high pass filter in a frequency characteristic is changed, and thus directivity of the reproduced sound can be changed.

Furthermore, the first filter 50 is composed of an equalization filter that equalizes a frequency characteristic of a demodulated sound or an inverse filter that suppresses unnecessary intermodulation distortion at the time of self-demodulation, so as to form a filter having a frequency characteristic of improving a sound quality of a beam sound, or making up for or emphasizing the audible band signal having passed through the second filter, such that the sound effect can be further improved.

Fourth Embodiment

Figure 9:
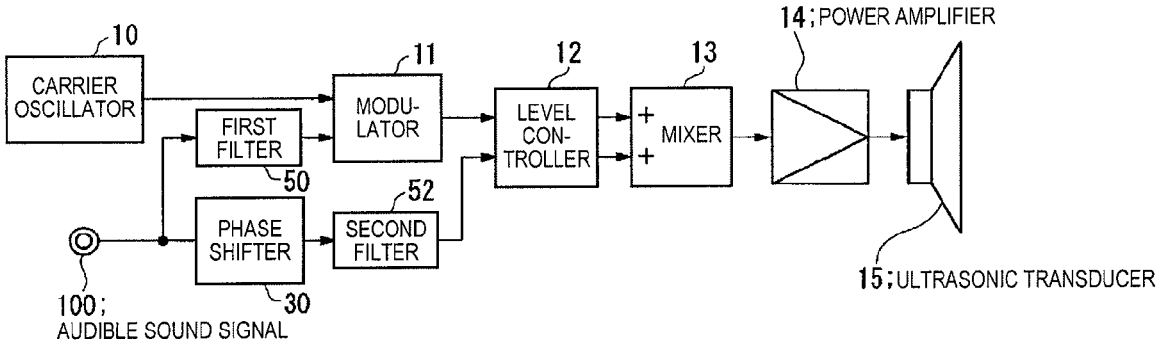
FIG. 9 is a block diagram illustrating a structure of a speaker device according to a fourth embodiment of the invention.

FIG. 9 shows a structure of a speaker device according to a fourth embodiment of the invention. The speaker device according to the fourth embodiment of the invention is different from the speaker device according to the third embodiment of the invention in that an audible frequency band input signal is input to a level controller through a second filter having a different pass band characteristic from a first filter in a state where a phase of the audible frequency band input signal is shifted by 90 degrees by the phase shifter. Since the other structure is the same as the structure of the speaker device according to the third embodiment, the same constituent elements as those in the third embodiment are denoted by the same reference numerals, and the repetitive description will be omitted.

In FIG. 9, the speaker device according to the fourth embodiment of the invention includes a carrier oscillator 10 that generates an ultrasonic frequency band carrier wave, a first filter 50 that receives the audible frequency band input signal and has the predetermined pass band characteristic, a modulator 11 that modulates the ultrasonic frequency band carrier wave output by the carrier oscillator 10 with an audible frequency band input signal that is an output signal of the first filter 50, a phase shifter 30 that shifts a phase of the audible frequency band input signal by 90 degrees, a second filter 52 that has the different pass band characteristic from the first filter 50, a level controller 12 that controls a level ratio between the modulated wave output by the modulator 11 and the audible frequency band signal that is the output signal of the second filter 52, a mixer 13 that mixes the modulated wave and the audible frequency band signal whose levels are controlled by the level controller 12 so as to generate a synthesis wave, a power amplifier 14 that amplifies the output of the mixer 13 to a predetermined level, and an ultrasonic transducer 15 that is driven by the synthesis wave output by the power amplifier 14 and reproduces a signal sound. Further, in the speaker device according to the fourth embodiment of the invention shown in FIG. 9, a portion composed of the carrier oscillator 10, the first filter 50, the modulator 11, the second filter 52, the phase shifter 30, the level controller 12, and the mixer 13 corresponds to the speaker control device according to the invention.

In the speaker device according to the fourth embodiment of the invention that has the above-described structure, the ultrasonic frequency band carrier wave is generated by the carrier oscillator 10, and is input to one input terminal of the modulator 11.

Further, the audible frequency band input signal is input to the first filter 50 having the predetermined pass band characteristic from the signal input terminal 100, and the signal having the predetermined pass band is output from the first filter 50, and the output signal is input to the other input terminal of the modulator 11.

The modulator 11 modulates the ultrasonic frequency band carrier wave output by the carrier oscillator 10 with the audible frequency band signal that is the output signal of the first filter 50, and the modulated wave output by the modulator 11 is input to one input terminal of the level controller 12.

Meanwhile, the audible frequency band input signal is input to the phase shifter 30 through the signal input terminal 100. In a state where the phase of the audible frequency band input signal is shifted by 90 degrees by the phase shifter 30, the audible frequency band input signal is input to the second filter 52 that has the different pass band characteristic from the first filter 50, the signal having the predetermined pass band characteristic is output from the second filter 52, and the output signal is input to the other input terminal of the level controller 12.

The level controller 12 controls a level ratio between the modulated wave output by the modulator 11 and the audible frequency band input signal that is the output signal of the second filter 52 to a predetermined ratio (set value).

The mixer 13 mixes the modulated wave and the audible frequency band signal whose levels are controlled by the level controller 12 so as to generate a synthesis wave. The synthesis wave is amplified to the predetermined level by the power amplifier 14, and is output to the ultrasonic transducer 15. The ultrasonic transducer 15 is driven with the output of the power amplifier 14, and reproduces a signal sound.

In the speaker device according to the fourth embodiment of the invention, since the level controller controls the level ratio between the modulated wave and the audible frequency band input signal to the predetermined ratio, it is possible to change a directivity angle of the sound output of the ultrasonic transducer. Further, since the modulated wave and the audible frequency band signal are mixed with each other after shifting the phase of the audible frequency band signal by 90 degrees, the positive and negative asymmetry in amplitude of the synthesis waveform is suppressed. For this reason, the load is reduced which is applied to the vibrating membrane or the driving circuit of the ultrasonic transducer, which lengthens a life span of a system.

Further, the second filter 52 is composed of a high pass filter (HPF). In addition, a cutoff frequency of the high pass filter in a frequency characteristic is changed, and thus directivity of the reproduced sound can be changed. As a result, it is possible to minutely control directivity.

Further, the first filter is composed of an equalization filter that equalizes a frequency characteristic of a demodulated sound or an inverse filter that suppresses unnecessary intermodulation distortion at the time of self-demodulation, so as to form a filter having a frequency characteristic of improving a sound quality of a beam sound, or making up for or emphasizing the audible band signal having passed through the second filter, such that the sound effect can be further improved.

Fifth Embodiment

Figure 10:
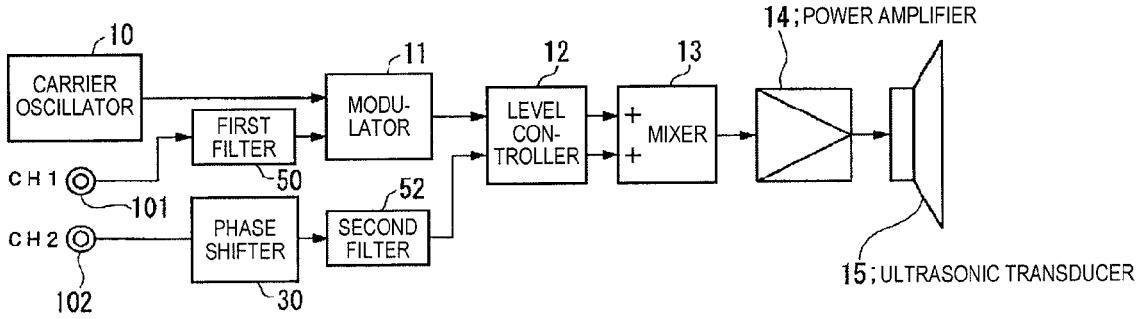
FIG. 10 is a block diagram illustrating a structure of a speaker device according to a fifth embodiment of the invention.

FIG. 10 shows a structure of a speaker device according to a fifth embodiment of the invention. The speaker device according to the fifth embodiment of the invention is different from the speaker device according to the fourth embodiment of the invention in that in the structure of the speaker device according to the fourth embodiment of the invention, a channel CH1 of a first audible frequency band signal (signal output as a signal having high directivity) that is input to the modulator through the first filter is separated from a channel CH2 of a second audible frequency band signal (signal output as a signal having low directivity) that is input to the level controller through the phase shifter and the second filter, and a signal obtained by mixing the first audible frequency band signal and the second audible frequency band signal is output. Since the other structure is the same as the structure of the speaker device according to the third embodiment, the same constituent elements as those in the third embodiment are denoted by the same reference numerals, and the repetitive description will be omitted.

In FIG. 10, the speaker device according to the fifth embodiment of the invention includes a first signal input terminal 101 that receives the first audible frequency band signal output as a sound having high directivity and a second signal input terminal 102 that receives the second audible frequency band signal output as a sound having low directivity. Further, the speaker device according to the fifth embodiment of the invention is constructed such that the first audible frequency band signal is supplied to the modulator 11 through the first signal input terminal 101, and the second audible frequency band signal is input to the level controller 12 through the second signal input terminal 102.

In the speaker device according to the fifth embodiment of the invention that has the above-described structure, the first signal input terminal 101 receives the first audible frequency band signal output as a sound having high directivity and the second signal input terminal 102 receives the second audible frequency band signal output as a sound having low directivity. The first audible frequency band signal is input to the modulator 11, and the modulator 11 modulates the ultrasonic frequency band carrier wave input by the carrier oscillator 10 with the first audible frequency band signal.

The level controller 12 controls a level ratio between the modulated wave output by the modulator 11 and the second audible frequency band input signal to a predetermined ratio (set value). The synthesis wave is amplified to the predetermined level by the power amplifier 14, and is output to the ultrasonic transducer 15. The ultrasonic transducer 15 is driven with the output of the power amplifier 14, and reproduces a signal sound.

The speaker device according to the fifth embodiment of the invention is constructed such that the channel CH1 outputting the first audible frequency band signal as the sound having high directivity is separated from the channel CH2 outputting the second audible frequency band signal as the sound having low directivity, and the synthesis wave obtained by mixing the first audible frequency band signal and the second audible frequency band signal is reproduced. For example, a main voice (main vocal or sound announce) is assigned to the channel CH1 and a sub-voice (BGM, effect sound, or the like) is assigned to the channel CH2. As a result, it is possible to perform effective voice area guidance through one speaker device.

Sixth, Seventh, and Eighth Embodiments

Figure 18:
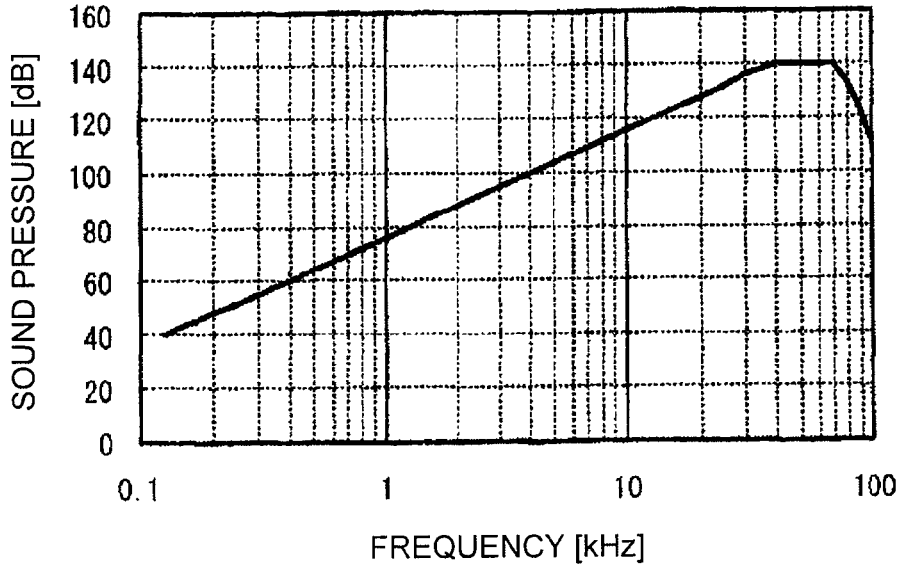
FIG. 18 is a diagram illustrating an example of a frequency characteristic of an electrostatic ultrasonic transducer.

In the electrostatic ultrasonic transducer shown in FIG. 2, shapes and sizes of units of the transducer are optimized such that the maximum sound pressure is outputted in the ultrasonic frequency band. For this reason, sensitivity (output sound pressure) of the audible frequency band is lowered, for example, as shown in FIG. 18. However, as in a piezoelectric transducer, if the corresponding frequency is out of a resonance frequency, the sound pressure is not rapidly lowered. Generally, as shown in FIG. 18, a frequency characteristic is obtained in which the sound pressure is gradually lowered from the ultrasonic frequency band (high frequency band) to the audible frequency band (low frequency band).

As such, the electrostatic ultrasonic transducer does not have a uniform output sound pressure frequency characteristic in the audible frequency band. If the input audible sound signal is reproduced as a direct sound from the transducer without the frequency characteristic of the audible sound signal being corrected, the audible sound signal may be reproduced as a sound in which the high frequency band is emphasized and a balance is collapsed.

In order to solve the above-described problems, in the speaker devices according to the sixth to eighth embodiments, a third filter (balance correcting filter) is additionally provided which equalizes (uniforms) the audible frequency band output characteristic of the transducer (output characteristic of the direct sound).

Figure 15:
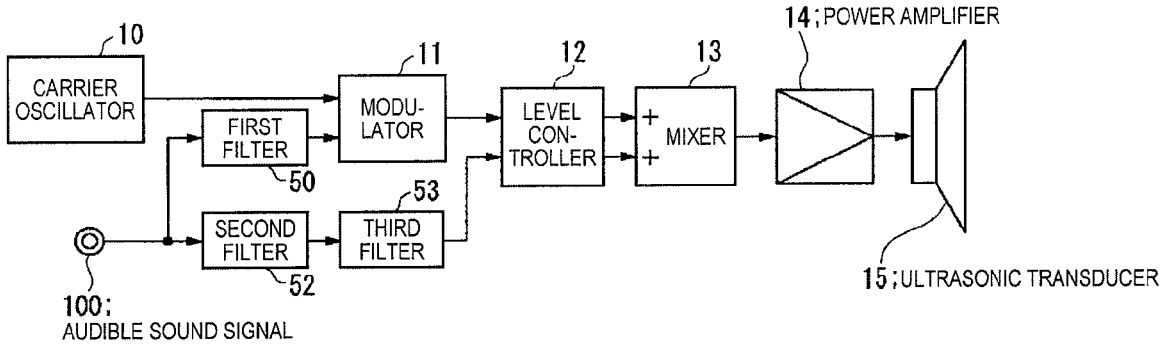
FIG. 15 is a block diagram illustrating a structure of a speaker device according to a sixth embodiment of the invention.

FIG. 15 is a block diagram illustrating a structure of a speaker device according to a sixth embodiment of the invention. The speaker device according to the sixth embodiment of the invention shown in FIG. 15 is different from the speaker device according to the third embodiment of the invention shown in FIG. 8 in that a third filter 53 is inserted in the back of a second filter. Since the other structure is the same as the structure of the speaker device according to the third embodiment, the same constituent elements as those in the third embodiment are denoted by the same reference numerals, and the repetitive description will be omitted.

Figure 16:
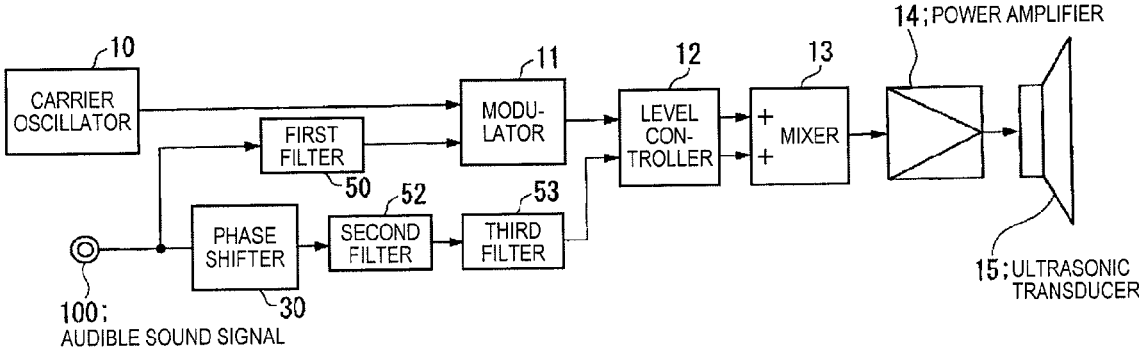
FIG. 16 is a block diagram illustrating a structure of a speaker device according to a seventh embodiment of the invention.

FIG. 16 is a block diagram illustrating a structure of a speaker device according to a seventh embodiment of the invention. The speaker device according to the seventh embodiment of the invention shown in FIG. 16 is different from the speaker device according to the fourth embodiment of the invention shown in FIG. 9 in that a third filter 53 is inserted in the back of a second filter. Since the other structure is the same as the structure of the speaker device according to the fourth embodiment, the same constituent elements as those in the fourth embodiment are denoted by the same reference numerals, and the repetitive description will be omitted.

Figure 17:
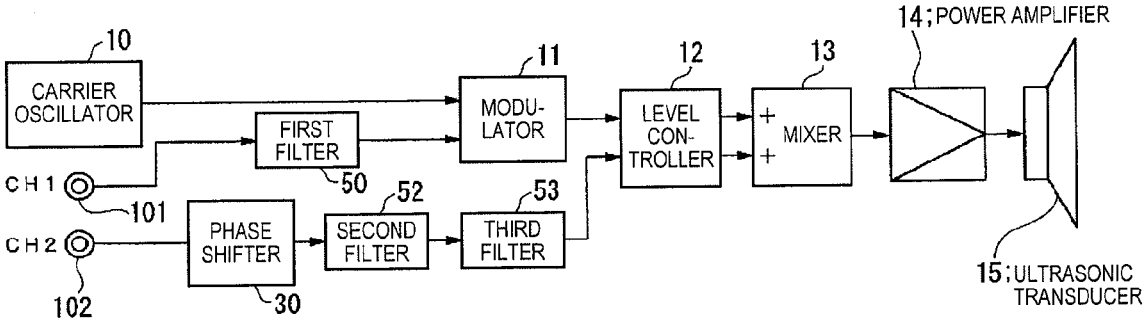
FIG. 17 is a block diagram illustrating a structure of a speaker device according to an eighth embodiment of the invention.

FIG. 17 is a block diagram illustrating a structure of a speaker device according to an eighth embodiment of the invention. The speaker device according to the eighth embodiment of the invention shown in FIG. 17 is different from the speaker device according to the fifth embodiment of the invention shown in FIG. 10 in that a third filter 53 is inserted in the back of a second filter. Since the other structure is the same as the structure of the speaker device according to the fifth embodiment, the same constituent elements as those in the fifth embodiment are denoted by the same reference numerals, and the repetitive description will be omitted.

Figure 19:
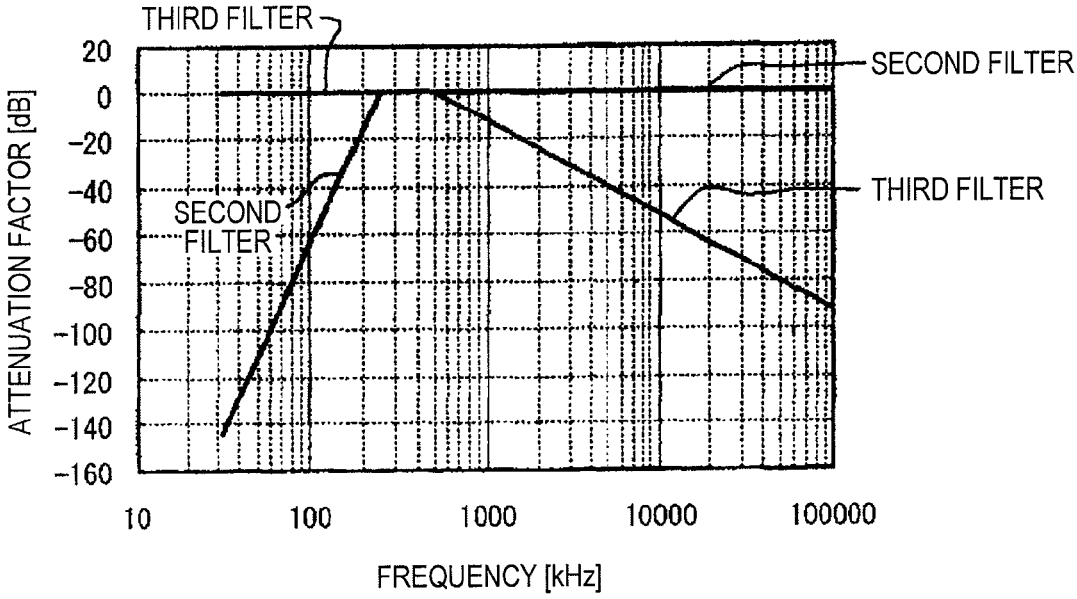
FIG. 19 is a diagram illustrating an example of pass characteristics of a second filter and a third filter.
Figure 20:
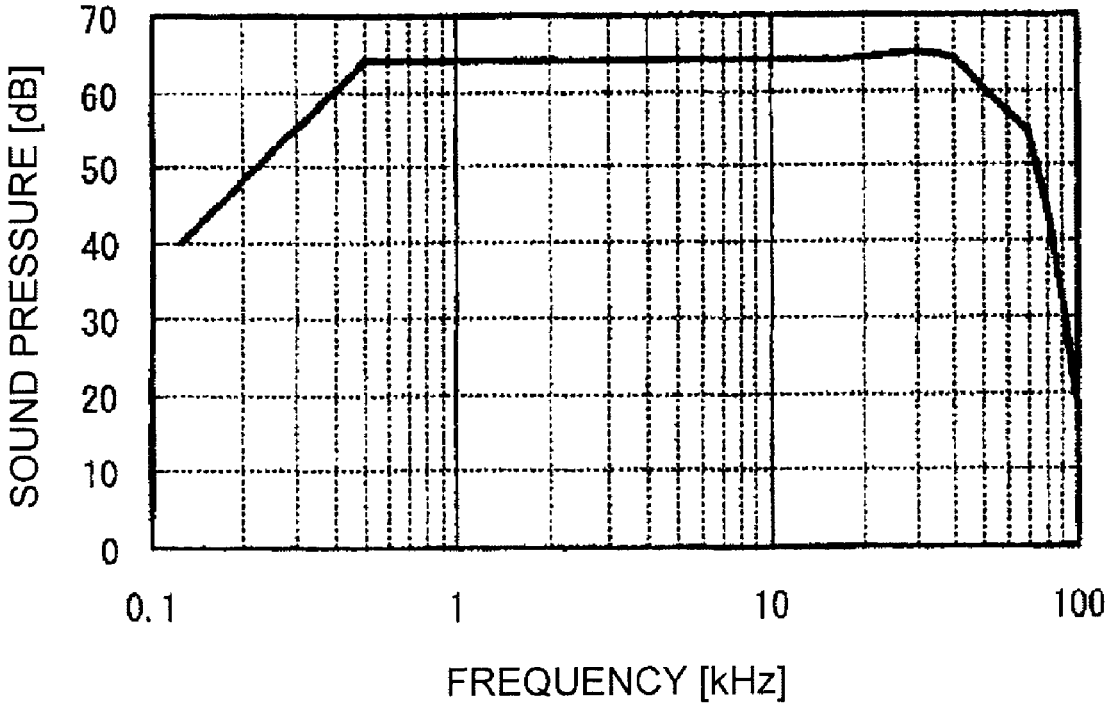
FIG. 20 is a diagram illustrating a frequency characteristic of a direct sound that is output from an ultrasonic transducer.

The third filter 53 has a pass characteristic that becomes a characteristic opposite to an output characteristic (attenuation characteristic) of the transducer in the audible frequency band. For example, when the transducer has the output characteristic shown in FIG. 18, by using the third filter having the pass characteristic shown in FIG. 19, the frequency characteristic of the direct sound finally output from the transducer (signal component of an audible frequency band reproduced through the second filter and the third filter) can be made uniform, as shown in FIG. 20. As a result, a reproducing balance of the direct sound (sound having low directivity) that is output from the transducer is kept, and the sound quality can be prevented from being deteriorated.

According to the embodiments of the invention, since a function as a super-directivity speaker and a function as a loudspeaker can be freely switched according to the necessity and used, a system can be small-sized when being used for sound amplification and communication.

Further, the level ratio between the level of the demodulated sound and the level of the direct sound is changed or a cutoff frequency of the filter is changed, which controls directivity of the reproduced sound (directivity angle).

Further, since the anterior-posterior asymmetry of the membrane amplitude can be suppressed by shifting the phase of the audible sound wave, the load that is applied to the membrane or the circuit is reduced, which lengthens a life span of a system.

Furthermore, the channel outputting the signal as the sound having high directivity (main vocal or sound announce) is separated from the channel outputting the signal as the sound having low directivity (BGM, effect sound, or the like), and the synthesis wave obtained by mixing the signals is output. As a result, it is possible to perform effective voice area guidance through one speaker device.

The entire disclosure of Japanese Patent Application Nos: 2006-057324, filed Mar. 3, 2006 and 2007-026549, filed Feb. 6, 2007 are expressly incorporated by reference herein.

What is claimed is:

1. A speaker device comprising:

a carrier wave generating unit that generates an ultrasonic frequency band carrier wave;

a modulating unit that modulates the ultrasonic frequency band carrier wave output by the carrier wave generating unit with an audible frequency band input signal;

a level controller that controls a level ratio between a modulated wave output by the modulating unit and the audible frequency band input signal;

a mixer that mixes the modulated wave and the audible frequency band input signal whose levels are controlled by the level controller so as to generate a synthesis wave;

an ultrasonic transducer that is driven with the synthesis wave and reproduces a signal sound;

a first signal input terminal that receives a first audible frequency band signal output as a sound having high directivity; and a second signal input terminal that receives a second audible frequency band signal output as a sound having low directivity;

wherein the first audible frequency band signal is supplied to the modulating unit from the first signal input terminal, and the second audible frequency band signal is supplied to the level controller from the second signal input terminal.

2. The speaker device according to claim 1, wherein the ultrasonic transducer is an electrostatic ultrasonic transducer.

3. A speaker control device that drives an ultrasonic transducer so as to reproduce a signal sound, the speaker control device comprising:

a carrier wave generating unit that generates an ultrasonic frequency band carrier wave;

a modulating unit that modulates the ultrasonic frequency band carrier wave output by the carrier wave generating unit with an audible frequency band input signal;

a level controller that controls a level ratio between a modulated wave output by the modulating unit and the audible frequency band input signal;

a mixer that mixes the modulated wave and the audible frequency band input signal whose levels are controlled by the level controller so as to generate a synthesis wave;

a first signal input terminal that receives a first audible frequency band signal output as a sound having high directivity; and a second signal input terminal that receives a second audible frequency band signal output as a sound having low directivity, wherein the first audible frequency band signal is supplied to the modulating unit from the first signal input terminal, and the second audible frequency band signal is supplied to the level controller from the second signal input terminal, wherein the ultrasonic transducer is driven with the synthesis wave.

4. The speaker device according to claim 3, wherein the ultrasonic transducer is an electrostatic ultrasonic transducer.

* * * * *